US005693461A

United States Patent [19]

Bagchi et al.

[11] Patent Number: 5,693,461

[45] Date of Patent: *Dec. 2, 1997

[54] MIXED PACKET COLOR PHOTOGRAPHIC SYSTEM

[75] Inventors: Pranab Bagchi, Webster; Tienteh Chen, Penfield; Thomas Joseph Dannhauser, Pittsford; John Derek Lewis; Mark Anthony Whitson, both of Webster, all of N.Y.

[73] Assignee: Eastman Kodak Company, Rochester, N.Y.

[ * ] Notice: The term of this patent shall not extend beyond the expiration date of Pat. No. 5,399,480.

[21] Appl. No.: 407,885

[22] Filed: Mar. 21, 1995

[51] Int. Cl.[6] ..... G03C 1/005; G03C 1/494

[52] U.S. Cl. ..... 430/640; 430/642; 430/503; 430/531; 430/536; 430/537; 430/539; 430/627; 430/628; 430/567; 430/569

[58] Field of Search ..... 430/640, 642, 430/503, 531, 536, 537, 539, 627, 628, 567, 569

[56] References Cited

U.S. PATENT DOCUMENTS

| | | | |
|---|---|---|---|
| 5,026,632 | 6/1991 | Bagchi et al. | 430/545 |
| 5,399,480 | 3/1995 | Whitson et al. | 430/531 |
| 5,441,865 | 8/1995 | Lewis et al. | 430/567 |

FOREIGN PATENT DOCUMENTS 606077 7/1994 European Pat. Off. .

*Primary Examiner*—Geraldine Letscher
*Attorney, Agent, or Firm*—Andrew J. Anderson

[57] ABSTRACT

This invention describes the composition and method of preparation of heteroflocculated packet emulsion clusters containing a light sensitive and selectively photosensitized silver halide emulsion particles and particles of photographic agents such as dye-forming coupler particles. The silver halide emulsion particles are associated with a layer of adsorbed peptizing gelatin with an isoelectric pH of $P_1$ and the grafted gelatin of the gelatin-grafted-polymer particles comprising the photographic agent has an isoelectric pH of $P_2$ such that $P_1$ is different than $P_2$. At least one of the peptizing and grafted gelatins is an isoing gelatin which is sufficiently derivatized to remove ionic groups thereof such that approaching the isoelectric pH in an aqueous solution of the isoing gelatin causes massive heteroflocculation. Formation of packet emulsion clusters is achieved by heteroflocculation between oppositely charged silver halide particles and gelatin-grafted-latex polymer particles comprising the photographic agents by shift of the pH to within 0.5 pH units of the isoelectric pH of the isoing gelatin and at a value between the two isoelectric pH values of two different types of gelatins used. The heteroflocculated packet emulsions can be further stabilized via hardening of the gelatins surrounding the particles in the packet clusters using a concentrated gelatin hardener. Such packet emulsion clusters are suitable for use in mixed packet color photography.

27 Claims, 8 Drawing Sheets

1 μm

1 μm

10 μm

MIXED PACKET COLOR PHOTOGRAPHIC SYSTEM

FIELD OF THE INVENTION

This invention relates to photosensitive packet comprising dye-forming couplers, silver halide emulsion compositions, and methods of preparing said compositions for use in mixed-packet color photographic elements.

RELATED ART (RA-1) T. H. James, "The Theory of the Photographic Process," 4th Edition, New York (1977).

(RA-2) K. R. Hollister and E. J. Perry, U.S. Pat. No. 3,813,251 (1974), describes the preparation of AgX grains using thioether group containing acrylate copolymers; M. J. Fitzgerald, "Synthetic Silver Halide Emulsion Binders," U.S. Pat. No. 3,816,129 (1974).

(RA-3) P. Bagchi, "Gelatin-Grafted-Polymer Particles," U.S. Pat. No. 4,920,004 (1990).

(RA-4) P. Bagchi, M. D. Sterman, and H. M. Low, "Photographic Element Having Polymer Particles Covalently Bonded to Gelatin," U.S. Pat. No. 4,855,219 (1989); K. M. O'Conner, R. P. Szajewski, and P. Bagchi, "Control of Pressure-Fog with Gelatin-Grafted and Case-Hardened Gelatin-grafted-soft Polymer Particles," U.S. Pat. No. 5,066,572 (1991); P. Bagchi, R. F. Reithal, T. J. Chen, and S. Evans, "Photoresist Dichromate Composition Containing Gelatin Coated Particles," U.S. Pat. No. 5,055,379 (1991).

(RA-5) P. Bagchi, "Theory of Stabilization of Spherical Colloidal Particles by Nonionic Polymers," J. Colloid and Interface Science 47, 100 (1974).

(RA-6) P. Bagchi and W. L. Gardner, "Use of Gelatin-Grafted and Case-Hardened Gelatin-grafted-polymer Particles for Relief from Pressure Sensitivity of Photographic Products," U.S. Pat. No. 5,026,632 (1991); P. Bagchi and W. L. Gardner "Case-Hardened Gelatin-Grafted-Polymer Particles," U.S. Pat. No. 5,248,558 (1993).

(RA-7) W. Schmidt, "Photographic Material," U.S. Pat. No. 4,973,547 (1990); S. A. King and J. E. Maskasky, "Modified Peptizer Twinned Grain Silver Halide Emulsions and Process for Their Preparation," U.S. Pat. No. 4,942,120 (1990).

(RA-8) T. J. Chen, Describes loading of photographically useful compounds into latex particles for delivery in photographic coating, U.S. Pat. No. 4,199,363 (1980).

(RA-9) P. Bagchi, S. J. Sargeant, J. T. Beck, and B. Thomas, "Polymer Co-Precipitated Coupler Dispersion," U.S. Pat. No. 5,091,296 (1992) and U.S. Pat. No. 5,279,931 (1994).

(RA-10) H. Bains, E. P. Davey, and E. T. Teal, U.S. Pat. No. 2,618,553 (1946) describes a mixed-packet color photographic process.

(RA-11) P. Bagchi, B. V. Gray, and S. M. Birnbaum, "Preparation of Model Polyvinyltoluene Latexes and Characterization of Their Surface Charge by Titration and Electrophoresis," J. Colloid and Interface Science 69, 502 (1979).

(RA-12) H. G. Curme and C. C. Natale, J. Phys. Chem. 63, 3009 (1964).

(RA-13) K. Sato, S. Ohno, and S. Yamada, "Silver Halide Photographic Material," U.S. Pat. No. 4,877,720 (1989).

(RA-14) N. Sujimoto, T. Kojima, and Y. Mukunoki, "Silver Halide Photographic Light-Sensitive Material," U.S. Pat. No. 4,464,462 (1984).

(RA-15) A. G. Van Paesschen, "Polymerization of Monomeric Couplers," U.S. Pat. No. 4,080,211 (1978).

(RA-16) J. J. Chechak and S. S. Firke, "Resin Salt of Couplers in Mixed-Packet Photographic Emulsions," U.S. Pat. No. 2,698,796 (1955).

(RA-17) L. Godowsky and L. M. Minsk, "Mixed-Packet Photographic Emulsions Using Resin Couplers," U.S. Pat. No. 2,698,797 (1955).

(RA-18) J. H. Van Campen and J. W. Gates, "Modifiers for Photographic Packet Emulsions," U.S. Pat. No. 2,763,552 (1956).

(RA-19) V. Tulagin and R. D. Jackson, "Mixed-Packet Photographic Emulsions," U.S. Pat. No. 2,965,484 (1960).

(RA-20) L. Godowsky, "Mixed-Packet Photographic Emulsions," U.S. Pat. No. 2,698,794 (1955).

(RA-21) K. W. Schranz et al., "Photographic Recording Material," U.S. Pat. No. 4,865,940 (1989).

(RA-22) A. G. E. Mignot, "Silver Halide Precipitation Process with Deletion of Materials, U.S. Pat. No. 4,334,012 (1982).

(RA-23) S. Urabe, "Process for Preparing Silver Halide Grains," U.S. Pat. No. 4,879,208 (1989).

(RA-24) J. I. Cohen, W. L. Gardner, and A. H. Herz, Adv. Chem. Ser. 45, 198 (1973).

(RA-25) A. Holland and A. Fieinerman, J. Appl. Photographic. Eng. 8, 165 (1982).

(RA-26) Anonymous, "Photographic Silver Halide Emulsions, Preparations, Addenda, Processing, and Systems," Research Disclosure 308, p. 993, December 1989.

(RA-27) D. R. Bassett and K. L. Hoy, "The Expansion Characteristics of Carboxylic Emulsion Polymers-I. Particle Expansion Determination by Sedimentation," in Polymer Colloids-II, R. M. Fitch, Ed., Plenum, New York, 1978, p. 1.

(RA-28) P. Bagchi and S. M. Birnbaum, "Effect of pH on the Adsorption of Immunoglobulin-G on Anionic Poly (vinyltoluene) Model Latex Particles," J. Colloid and Interface Sci. 83, 460 (1981).

(RA-29) H. C. Yutzy and P. J. Russell, "Methods of Preparing Photographic Emulsions," U.S. Pat. No. 2,614,929 (1952).

(RA-30) J. D. Lewis, M. A. Whitson, T. J. Dannhauser, T. Chen, and P. Bagchi, "Gelatin-Grafted-Polymer Particles as Peptizer for Silver Halide Emulsions," U.S. application, Ser. No. 08/1,361 filed Jan. 7, 1993.

(RA-31) M. A. Whitson, J. D. Lewis, T. Chen, T. J. Dannhauser and P. Bagchi, "Attachment of Gelatin-Grafted-Polymer Particles To Preformed Silver Halide Grains," U.S. application Ser. No. 08/122,191 filed Sep. 14, 1993.

(RA-32) T. A. Russel, "Method of Multiple Coatings," U.S. Pat. No. 2,761,791 (1956).

(RA-33) R. G. Willis and J. Texter, "Heat Image Shipping Separation Systems," U.S. Pat. No. 5,270,145 (1993).

(RA-34) R. Hogg, T. W. Healey, and D. W. Furestenau, Trans. Farad. Soc. 62, 1638 (1966).

(RA-35) P. T. S. Lau, P. W. Tang and S. W. Cowan, "Polymeric Couplers," U.S. Pat. No. 5,043,469 (1991).

(RA-36) Eastman Kodak Publication, "Kodak Filters For Scientific and Technical Uses," 3rd edition, Eastman Kodak Company, Rochester, N.Y., 1981.

BACKGROUND OF THE INVENTION

Photographic emulsions typically comprise silver halide particles dispersed in an aqueous medium. Traditionally, various types of gelatin have been used as a peptizer for the precipitation of photographic silver halide emulsions. This results in a layer of adsorbed gelatin surrounding each silver halide grain. The hydrated thickness of the gelatin layer may vary anywhere from 10 to 60 nm. Silver halide particles comprising silver halide grains each surrounded by a layer of peptizing gelatin are referred to herein as "silver halide-gelatin particles".

Photographically useful compounds, such as filter dyes, development inhibitor releasing couplers, development inhibitor anchimeric release couplers, dye-forming couplers, nucleators, ultraviolet radiation absorbing materials, development accelerators (sometimes referred to as boosters in the art), developers, sensitizing dyes, and the like can be incorporated into photographic emulsions. Typically such photographically useful compounds are added to an emulsion in the form of oil-in-water dispersions resulting in a photographic composition comprising silver halide particles and dispersed droplets comprising the photographically useful compound.

Conventional color photographic elements comprise a plurality of layers coated on a support. In such a photographic element there is at least one color sensitive layer for each of the colors red, green and blue. Mixed-layer color photographic systems have been proposed. A mixed-layer color photographic system is one in which a single photographic layer is made up of silver halide grains with different spectral sensitizations. The manufacturing benefit of such a system is clear: reduction of the number of layers in a color photographic system. The ability to collapse (reduce the number of) differently sensitized layers (different by color or by speed) can lead to cost savings.

There are two kinds of mixed-layer color photographic systems. The system in which differently sensitized silver halide emulsion grains are mixed together in a single layer without incorporation of the corresponding image-forming dye components (often referred to in the art as couplers) is generally called a mixed-grain coating see U.S. Pat. No. 2,618,553 to Bains et al. (RA-10).

The second type of mixed-layer system also contains differently sensitized silver halide emulsion particles but in addition contains different image-forming dye components associated with the silver halide sensitized for each region of the spectrum. The particles that are mixed may or may not be individual silver halide grains. In many coatings of this kind, silver halide grains of a certain sensitivity and the appropriate image-forming dye or dye component are both dispersed in a colloidal vehicle; this vehicle with its contents is then dispersed as globules in a continuous phase or "matrix" consisting of a second colloid vehicle not compatible with the first. A mixture of two or more such dispersions containing particles of different spectral sensitivity is commonly called a mixed-packet coating. However, there are other materials in which image-forming dyes or dye components are intimately associated with the color-sensitized silver halide grains themselves, as by adsorption or complex formation, and the grains are mixed in a single emulsion vehicle. Such materials are also considered mixed-packet materials.

The processing of mixed-packet materials is usually simpler than that of mixed-grain materials. This is the result of associating the proper image-forming dye or dye component with the silver halide sensitized for each region of the spectrum. A single chemical step can suffice, therefore, to form all the dye images, each under the control of the proper set of silver or silver halide grains. On the other hand, mixed-grain materials usually require not only the original exposure to the subject, but also two or more reversal exposures to light of different colors, each followed by a reversal development in a different color developer solution containing a soluble coupler to introduce the three dye components one after another and to form the three dye images, each under the control of the proper set of differently sensitized grains.

Because of the potential commercial value of an acceptable quality mixed-packet system, extensive work has been done as indicated in the prior art references U.S. Pat. No. 2,698,796 to Chechak et al., U. S. Pat. No. 2,698,797 to Godowsky et al., U.S. Pat. No. 2,763,552 to Van Campen et al., U.S. Pat. No. 2,965,484 to Tulagin et al., U.S. Pat. No. 2,698,794 to Godowsky, and U.S. Pat. No. 4,865,940 to Schranz (RA-16 through RA-21). However, none of the prior art mixed-packet systems has achieved commercial success.

In the early days of color photography, when photographic products were casted one layer at a time, a workable mixed packet system was considered to be of extremely high commercial value and research in mixed packet systems were pursued vigorously until the early fifties. However, the invention of simultaneous multilayer coating hoppers by Russel, U.S. Pat. No. 2,761,791 (RA-32), made the manufacturing of multilayer photographic packages so productive that there was very little commercial incentive to develop any highly technically challenging mixed packed systems. A survey of the literature will show that after about the mid nineteen hundred and fifties, research in mixed packet systems was virtually dropped in all photographic companies. However, in the present-day cost-sensitive, competitive environment, it is felt that collapsing of photographic layers without sacrificing quality of the image in photographic products can lead to substantial cost benefits in the manufacture of color recording materials. Because of such cost saving incentives, various inventions in the area of mixed packet color photographic concepts are re-appearing. See U.S. Pat. No. 4,865,940 to Shranz et al. (RA-21). Further, due to the digital imaging element market demands for fast image processing and environmentally clean photographic systems, various thermal image transfer systems are being developed for example, the system disclosed in U.S. Pat. No. 5,270,145 to Willis et al. (RA-33). In such imaging systems, conventional silver halide-dye images are thermally transferred to a laminated receiver sheet. Such conventional imaging systems would be immensely simplified if the lower image layer was a mixed packet layer, as dye transfer would take place from a single layer rather than a fully stacked multilayer conventional photographic element.

Therefore, there is a strong need to develop packet-emulsion systems for the fabrication of viable, low granularity, mixed-packet photographic systems.

U.S. patent application Ser. No. 08/001,361 filed Jan. 7, 1993 (RA-30), the disclosure of which is incorporated herein by reference, describes the precipitation of Ag-halide emulsions in the presence of gelatin-grafted polymer particles comprising a photographically useful compound. By the method disclosed in this application one obtains polymer particles directly attached to the Ag-halide grains. As elucidated in RA-30, there are many advantages associated with having such polymer particles attached to silver halide grain in emulsion systems, including the precipitation of mixed packet photographic systems. However, the method described in this patent application requires modification of known emulsion preparation processes to optimize the process for used with the gelatin-grafted-polymer particles.

Further, U.S. patent application Ser. No. 08/122,191, filed Sep. 14, 1995 (RA-31) discloses similar attachment of gelatin grafted-polymer particles comprising a photographically useful compound to conventionally pre-precipitated gelatin-silver halide emulsion grains. U.S application Ser. Nos. 08/001,361 and 08/122,191, however, disclose the formation of packet emulsion systems where each silver halide grain is surrounded by a single mono layer of attached dye-forming gelatin-grafted-coupler particles. In many situations, especially where the coupler particles are small compared to the silver halide grains, there may not be enough coupler to form a full dye density scale for adequate image reproduction. Depending on the silver halide equivalance of the coupling group, generally between 4 to 8 times the volume of coupling moiety as there is silver halide is needed to form a full dye scale.

Therefore there is a need to have enough coupler material associated with silver halide grains to form large enough dye-scale suitable for proper color rendition in the mixed-packet emulsions, which is especially true when the gelatin-grafted-coupler particles are somewhat small compared to the size of the silver halide grains utilized.

Problem to be Solved by the Invention

There is a need to provide and improve methods of formation of packet-emulsion systems and compositions thereof for use in conventional color photographic systems, mixed-packet color photographic systems and non-conventional environmentally safer heat processed dye-transfer imaging systems useful for digital pictorial imaging, that provide a full dyescale scale for proper reproduction of the original scene.

SUMMARY OF THE INVENTION

We have discovered that heteroflocculated clusters of gelatin-grafted-polymer particles containing photographic agents and preformed, pre-precipitated, conventional silver halide emulsions, permits the use of silver halide emulsions prepared by conventional manufacturing techniques well known and/or optimized for a particular photographic element, in preparation of packet emulsions for use in mixed packet color photography.

One aspect of this invention comprises a photosensitive silver halide packet emulsion composition comprising in an aqueous medium: (a) silver halide-gelatin particles comprising silver halide grains, each surrounded by a layer of adsorbed peptizing gelatin wherein the peptizing gelatin has an isoelectric pH of $P_1$; and (b) gelatin-grafted-polymer particles wherein the grafted gelatin has an isoelectric pH of $P_2$ which is different than $P_1$; wherein at least one of the peptizing and grafted gelatins is an isoing gelatin, and the gelatin-grafted-polymer particles and the silver halide gelatin-particles form a heteroflocculated, packet emulsion composition.

Another aspect of this invention comprises a method of preparing a photographic silver halide emulsion composition as described above comprising:

(i) mixing in an aqueous medium (a) silver halide-gelatin particles comprising silver halide grains, each surrounded by a layer of adsorbed peptizing gelatin wherein the peptizing gelatin has an isoelectric pH of $P_1$, and (b) gelatin-grafted-polymer particles wherein the grafted gelatin has an isoelectric pH of $P_2$ which is different than $P_1$, wherein at least one of the peptizing and grafted gelatins is an isoing gelatin, and (ii) adjusting the pH of the aqueous medium to a value that is between $P_1$ and $P_2$, and within 0.5 pH units of the isoelectric pH of an isoing gelatin, under agitation whereby gelatin-grafted-polymer particles and silver halide gelatin particles heteroflocculate to form a clustered heteroflocculated packet emulsion composition.

This method can further comprise the step of chemical cross linking the gelatin-grafted-polymer particles to the gelatin surrounding the silver halide grains using a gelatin hardener.

Yet another aspect of this invention comprises a mixed-packet photosensitive photographic element comprising a support bearing a layer containing at least two of the following packet emulsion clusters:

(a) silver halide particles sensitive to red light and comprising silver halide grains each surrounded with a layer of peptizing gelatin wherein the peptizing gelatin has an isoelectric pH of $P_{1a}$, and heteroflocculated with gelatin-grafted-cyan dye-forming coupler particles wherein the grafted gelatin has an isoelectric pH of $P_{2a}$ which is different than $P_{1a}$, to form a red packet cluster, (b) silver halide particles sensitive to green light and comprising silver halide grains each surrounded with a layer of peptizing gelatin wherein the peptizing gelatin has an isoelectric pH of $P_{1b}$ and hetero-flocculated with gelatin-grafted-magenta dye-forming coupler particles wherein the grafted gelatin has an isoelectric pH of $P_{2b}$ which is different than $P_{1b}$, to form a green cluster, or (c) silver halide particles sensitive to blue light and comprising silver halide grains each surrounded with a layer of peptizing gelatin wherein the peptizing gelatin has an isoelectric pH of $P_{1c}$ and hetero-flocculated with gelatin-grafted-yellow dye-forming coupler particles wherein the grafted gelatin has an isoelectric pH of $P_{2c}$ which is different than $P_{1c}$, to form a blue packet cluster, wherein in each packet emulsion (a), (b) and (c) at least one of the peptizing or grafted gelatins is losable.

In each packet element the gelatin of the two types of particles may be chemically bonded with a gelatin cross linking agent.

In preferred embodiments of the invention, gelatin-grafted-soft polymer particles are used comprising a polymer that has a glass transition temperature lower that room temperature (i.e. lower than about 25° C.). The compositions comprising the soft polymer particles tend to be less pressure sensitive than conventional silver halide emulsion compositions.

Advantageous Effect of the Invention

The invention has numerous advantages over prior photographic products and processes for their production. The invention provides heteroflocculated clusters of gelatin-grafted-polymer particles loaded with photographically useful compounds or gelatin-grafted-polymeric photographically useful compound and conventionally pre-precipitated silver halide grains. These photographically useful compounds are in close association with the silver halide grains and therefore can readily react during photographic processing. The ability to mix different spectrally sensitized silver halide grain-containing-packet-cluster that are surrounded by dye forming coupler particles complementary to the spectral sensitization of the silver halide particles allows mixing in one silver halide layer of a photographic element, packet clusters of magenta, cyan and yellow dye-forming couplers with development only of the coupler that is bound to the gelatin layer surrounding a particular sensitized silver halide grain.

The process of formation of cluster packets by heteroflocculation has the following advantages:

The process of cluster formation can be used to produce silver halide to coupler ratio of any desirable value as long as about half the particles have opposite charge on their surfaces. For low silver halide clusters, half the polymeric couplers would be grafted with gelatin of isoelectric pH of $P_2$ and the other half with a gelatin of isoelectric pH of $P_1$ and then heteroflocculated with silver halide grains pre-precipitated with gelatin with isoelectric pH of either $P_1$ or $P_2$.

Isolation of the cluster packets and their concentration can be easily achieved by isowashing procedure described in U.S. Pat. No. 2,614,929 to Yutzy et al. (RA-29).

Cluster size and size distribution control during the formation of the clusters can be easily achieved via the use of a suitable homogenization device such as a tissue homogenizer.

Cluster packets can be further stabilized if necessary via the use of conventional gelatin hardeners.

The process of cluster formation steps have the simplicity needed to produce a manufacturable high volume product.

DETAILED DESCRIPTION OF THE INVENTION

Figure 1A:
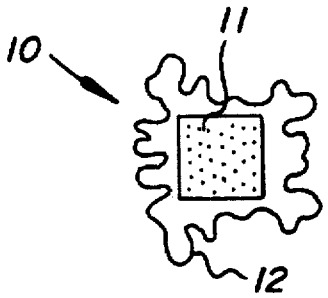
FIG. 1*a* illustrates a silver halide-gelatin particle which comprises a silver halide grain precipitated in an aqueous lime processed ossein gelatin medium.
Figure 1B:
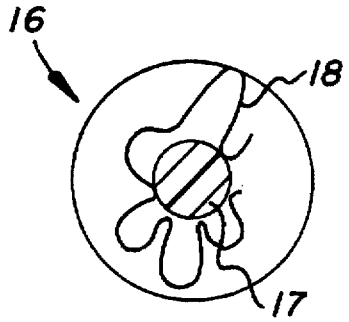
FIG. 1*b* illustrates phthalated-A (LPO) gelatin-B-grafted-polymer particle.

Coacervation and complex coacervation techniques have been used in the past and recently disclosed in U.S. Pat. No. 4,865,940 to Shranz et al. (RA-21) to a create packet emulsion system for constructing mixed packet color photographic systems. In this invention, the preparation of packet emulsions is achieved by controlled heteroflocculation, for example, as disclosed in Trans. Farad. Soc. 62, 1938 (1966) of Hogg et al. (RA-34) between oppositely charged gelatin precipitated silver halide emulsion particles (FIG. 1*a*) and gelatin-grafted polymeric couplers (or coupler containing polymer particles) (FIG. 1*b*). It has been shown in U.S. Pat. Nos. 4,855,219; 5,066,572; and 5,053,379 (RA-4) that when gelatin is grafted onto the surface of polymer particles the amine groups of the gelatin are used up, leading to a lowering of the isoelectric pH (IEP) of the gelatin. Table I shows a list of the IEP values of different gelatins, such as lime processed ossein (LPO) gelatin (A) and phthalated gelatins.

TABLE 1

Isoelectric pH Values Of Various Gelatins And Gel-G-Latexes

| Material | Isoelectric pH | Comments |
|---|---|---|
| Standard lime processed ossein gelatin (A) | 4.8 | (RA-24) |
| Gelatin (A) phthalated (B)* | 4.1 | (RA-24) |
| Gelatin-grafted-polymer particles (A)-g-latex | 4.0 | (RA-31) |
| Phthalated gelatin (B) grafted polymer particles | ≈3.3 | Estimate |

*Phthalated gelatin (B) was obtained by phthalation of 100 g of gelatin (A) with 5.0 g of phthalic anhydride as described in (RA-24).

A proviso in the fromation of such hereroflocculated packet emulsion is that one of the gelatins, either peptizing the silver halide grains or grafted onto the polymeric latex coupler particles, must be an "isoing gelatin". By isoing gelatin is meant a gelatin which is sufficiently derivatized to remove ionic groups thereof such that approaching the isoelectric pH in an aqueous solution of the gelatin causes massive heteroflocculation. Formation of packet emulsion clusters is achieved by heteroflocculation between oppositely charged silver halide particles and gelatin-grafted-latex polymer particles comprising the photographic agents by shift of the pH to within 0.5 pH units of the isoelectric pH of the isoing gelatin and at a value between the two isoelectric pH values of the two different types of gelatins used. Generally an isoing gelatin has a lower isoelectric pH than a nonisoing gelatin.

The gelatin derivatives which have been found to be especially useful as isoing gelatins in the process in accordance with our invention are those of the aromatic sulfonyl chlorides, the carboxylic acid chlorides, the carboxylic acid anhydrides, especially of the dicarboxylic type, the aryl isocyanates, and the 1,4-diketones. The following compounds have been found to be useful for preparing isoing gelatin derivatives suitable for use in our invention:

Sulfonyl chlorides

Figure 1C:
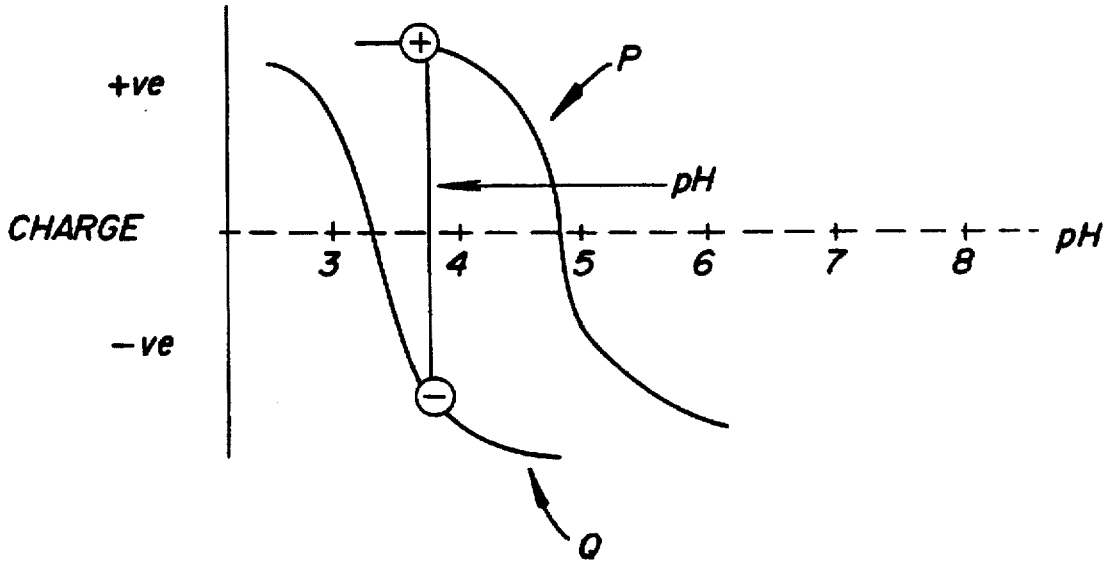
FIG. 1*c* illustrates the pH dependence of charge of standard lime processed ossein gelatin and that of phthalated gelatin-B-grafted-polymer particles.
Figure 2:
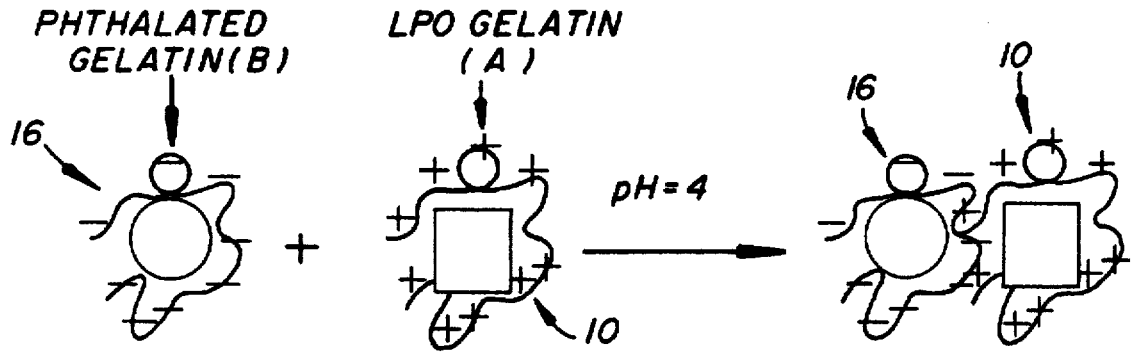
FIG. 2 illustrates initial stage of heteroflocculation.

Benzene sulfonyl chloride
p-Methoxybenzene sulfonyl chloride
p-Phenoxybenzene sulfonyl chloride
p-Bromobenzene sulfonyl chloride
p-Toluene sulfonyl chloride
m-Nitrobenzene sulfonyl chloride
m-Sulfobenzoyl dichloride
Napthalene-beta-sulfonyl chloride
p-Chlorobenzene sulfonyl chloride
m-Carboxy-4-bromobenzene sulfonyl chloride 1-chlorosulfonyl-2-hydroxy-3-naphthoic acid quionline-8-sulfonyl chloride m-Carboxybenzene sulfonyl chloride 2-amino-5-methylbenzene-sulfonyl chloride Carboxylic acid chloride Phthalyl chloride p-Nitrobenzoyl chloride Benzoyl chloride Ethyl chlorocarbonate Furoyl chloride Acid anhydrides Phthalic anhydride Benzoic anhydride Succinic anhydride Maleic anhydride Isatoic anhydride Isocyanates Phenyl isocyanate p-Bromophenyl isocyanate p-Chlorophenyl isocyanate p-Tolyl isocyanate p-Nitrophenyl isocyanate Alpha-naphthyl isocyanate Beta-naphthyl isocyanate 1,4-diketones Acetonyl acetone Dimethyl acetonyl acetone In a preferred embodiment of the invention, a LPO gelatin is used as the peptizing gelatin for silver halide emulsion particles, and a phthalated gelatin is used as the gelatin grafted onto the polymer particles. When an aqueous solution of LPO gelatin-coated silver halide emulsion particles are mixed with an aqueous solution of the phthalated gelatin-grafted-polymer particles, and the pH is lowered between 4.8 and 3.3 the LPO gelatin coated silver halide particles acquire a positive charge and the phthalated gelatin-grafted-polymer-particles have negative charge (FIG. 1*c*). Adjustment of the pH to near (e.g., within 0.5 pH units) the isoelectric pH of the isoing phthalated gelatin causes coagulation of the entire mixed composition. This adjustment of pH causes charge attraction (FIG. 2). Control of the "isoing" coagulation effect of the phthalated gelatin by agitation leads to heteroflocculated packet emulsion clusters as pictorially shown in FIG. 3.

Figure 4:
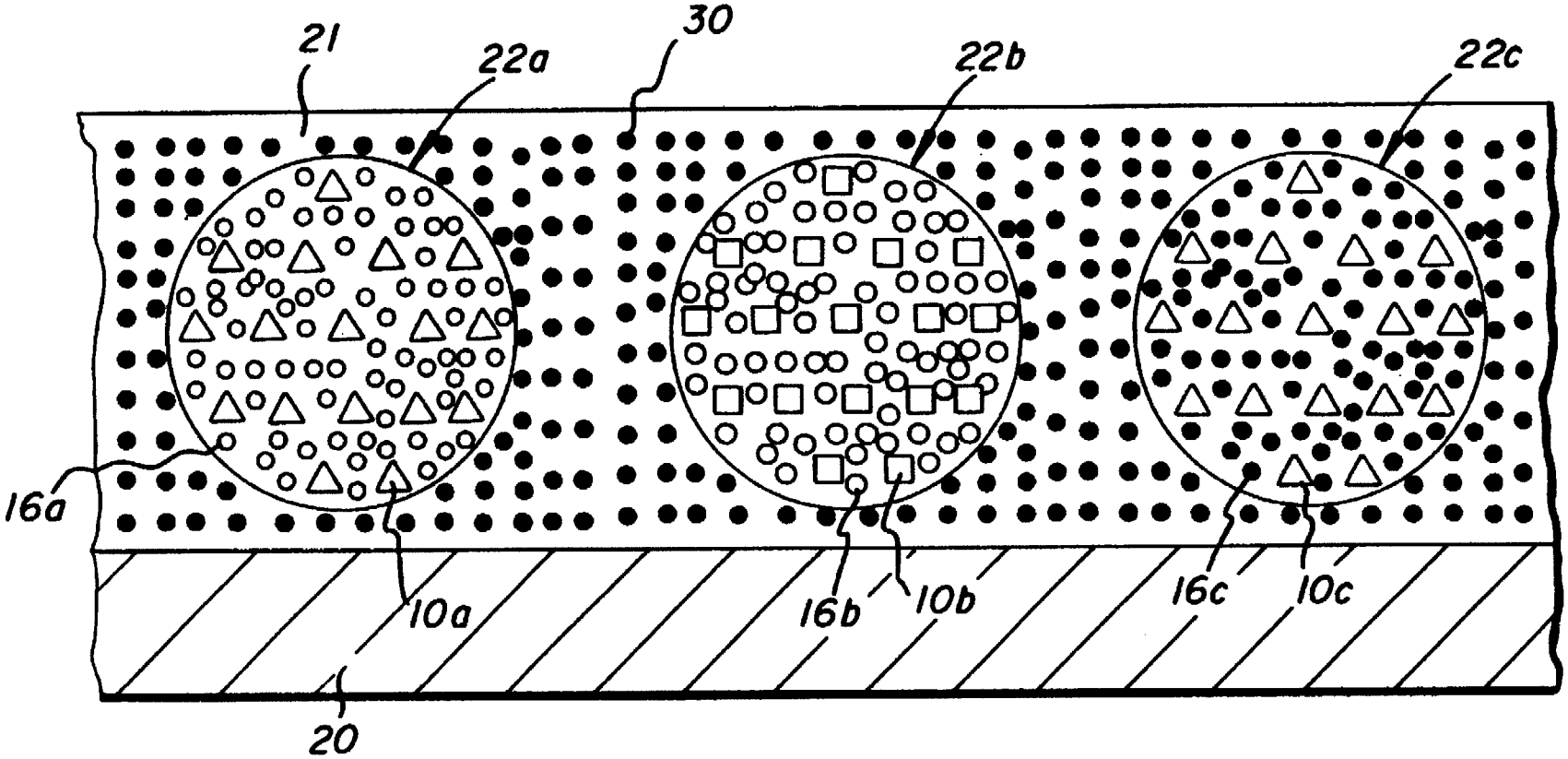
FIG. 4 illustrates the concept of a mixed packet layer using heteroflocculated packet emulsion clusters.

FIG. 4 shows the concept of a mixed packet system formed from a plurality of individually heteroflocculated clusters. The average diameter of such heteroflocculated emulsion packet clusters may range in size between 1 μm to 100 μm preferably between 1 μm and 50 μm. A silver halide-gelatin particle, 10, is illustrated in FIG. 1A in which a silver halide grain ii is surrounded by a layer of gelatin 12. The silver halide-gelatin particles can be prepared by any method. Various types of methods used in the preparation of photographic silver halide emulsions have been described in detail in prior art references, for example, T. H. James, "The Theory of the Photographic Process," 4th Edition, New York (1977) (RA-1); U.S. Pat. No. 4,334,012 to Mignot (RA-22) and U.S. Pat. No. 4,879,208 to S. Urabe (RA-23). The emulsion may be a AgCl, AgBr, AgI, AgCl(Br), AgCl(I), AgClBr(I), or AgBr(I) emulsion. Preferred are silver halide grains comprising silver chloride, silver iodobromide, and/or silver chlorobromide. The silver halide grains preferably have a single dimension ranging between about 10 nm to about 10,000 nm. The weight of gelatin used for precipitation of silver halide-gelatin particles for use in this invention depends on the crystal morphology or shape of the silver halide grains to be prepared and their sizes. It may range from about 2 grams of gelatin to about 200 grams of gelatin per mole of the silver halide emulsion prepared. The amount is determined by the size of the emulsion grains, such that after the emulsion is formed substantially all the gelatin is bound to the silver halide grain surface, as discussed more fully below. The emulsion particles may be cubic, octahedral, rounded octahedral, polymorphic, tabular or thin tabular emulsion grains. Preferred are silver halide grains having a cubic, octahedral, or tabular crystal structure. Such silver halide grains may be regular untwinned, regular twinned, or irregular twinned with cubic or octahedral faces. The silver halide grains may also be composed of mixed halides.

The gelatin starting material may be a regular lime processed or acid processed ossein (LPO) gelatin A or various derivatized gelatins as described in related art T. H. James, "The Theory of the Photographic Process," 4th Edition, New York (1977) (RA-1) and U.S. Pat. No. 5,026,632 to Bagchi et al. (RA-6), provided one gelatin used is an isoing gelatin as described above. Gelatins such as phthalated, acetylated, or alkylated gelatins, such as succinated gelatin, are particularly useful in some embodiments of this invention. Variation of the types of gelatin provides variations in the isoelectric pH of the formed particles. This variation in the isoelectric pH provides the basis for the formation of heteroflocculated packet emulsion systems, as discussed in more detail below. The gelatin adsorbed on the silver halide grains has an isoelectric pH of $P_1$.

Generally, the amount of gelatin surrounding each grain should be about 10 mg per sq meter of the surface of the emulsion grains. This consideration is similar to that provided for the gelatin-grafting-polymer particles, as discussed more fully below.

FIG. 1B illustrates a gelatin-grafted-polymer particle 16 comprising a polymer core 17 and a surrounding gelatin layer 18.

The preparation of gelatin-grafted-polymer particles has been extensively described earlier, for example, in U.S. Pat. No. 4,920,004 to Bagchi, (RA-3); U.S. Pat. No. 4,855,219 to Bagchi et al.; U.S. Pat. No. 5,066,572 to O'Conner et al. and U.S. Pat. No. 5,055,379 to Bagchi et al. (RA-4); and U.S. Pat. No. 5,026,632 to Bagchi et al. (RA-6), the disclosures of which are incorporated herein by reference. Polymers useful in the preparation of gelatin-grafted-polymer particles are any polymers capable of covalently bonding with gelatin, either directly or with the aid of a grafting agent. Preferred polymers that covalently bond directly with gelatin are homopolymers and copolymers of monomers containing active halogen atoms, isocyanates, epoxides, monomers containing aldehyde groups, and monomers containing chloroethylsulfone groups or vinyl sulfone groups. Preferred polymers that are capable of bonding with gelatin through the use of a cross linking agent include carboxylic acids, amine-containing monomers, and active methylene group-containing monomers.

Generally, the polymer particles are formed by emulsion polymerization, suspension polymerization, or limited coalescence to form a latex. The polymer particles in the latex generally have a diameter of about 10 to about $10^6$ nm. As mentioned above, the gelatin is then monomolecularly bonded to the surface of the polymer particles of the latex by direct chemical reaction or by the use of a chemical grafting agent. A gelatin grafting agent is a chemical compound that will allow bond formation between gelatin and a chemical moiety on the surface of the polymer particle. Typical of such chemical grafting agents suitable for the invention are carbamoylonium compounds, dication ether compounds, and carbodiimide compounds, for example the compounds disclosed in above-mentioned U.S. Pat. No. 5,066,572.

Of particular importance to this invention are the gelatin-grafted-polymer particles that have been prepared such that there is substantially no excess gelatin remaining in solution of the gelatin-grafted-polymer latex system. In other words, the gelatin-grafted-polymer samples that are useful for this invention have substantially all the gelatin molecules bound to the polymer particle surface. Therefore, the amount of gelatin to be used depends upon the specific surface area (S) of the latex particles. The specific surface area of polymer particles depends upon the mean particle diameter of the particle (D). S is given by $$S=6r/D \quad (1)$$

where r is the density of the polymer particle. The saturation adsorption of gelatin depends upon the pH and ionic strength of the solution. However, as a general rule the saturation adsorption of about 10 mg/sq meter of surface is a reasonable estimate. See J. Phys. Chem. 63, 3009 (1964) by Curme et al. and U.S. Pat. No. 5,091,296 to Bagchi et al. (RA-12 and RA-9). The gelatin-grafted-polymer particles useful in this invention are those that have been prepared at gelatin coverages that are less than about 10 mg of gelatin per sq meter of the polymer particle surface and preferably below about 8 mg of gelatin per sq meter of the polymer particle surface.

The gelatin starting material used to prepare the gelatin-grafted-polymer particles may be a regular lime processed or acid processed ossein gelatin or various derivatized gelatins as described in related art T. H. James, "The Theory of the Photographic Process," 4th Edition, New York (1977) (RA-1) and U.S. Pat. No. 5,026,632 to Bagchi et al. (RA-6). Gelatins such as phthalated, acetylated, alkylated, or succinated gelatin, may be particularly useful in some embodiments of this invention. Variation of the types of gelatin provides variations in the isoelectric pH of the formed particles. It is to be noted that the pH ($P_2$) of the gelatin-grafted-polymer particles generally differs from the isoelectric pH of the gelatin starting material, as discussed below. The gelatin in the gelatin-grafted-polymer particles has an isoelectric pH of $P_2$, which is different from $P_1$, the isoelectric pH of the gelatin adsorbed on the pre-precipitated silver halide grains, as illustrated in FIG. 1*c*. In FIG. 1*c*, the line P represents the pH dependence of charge of standard lime processed ossein (LPO) gelatin-A and the line Q represents that of phthalated lime processed ossein gelatin-B-grafted-polymer particles. The difference between $P_1$ and $P_2$, should be at least about one unit of pH value, preferably at least about 1.5 units, and more preferably about 2.0 units.

In general, the gelatin starting material used to prepare the gelatin-grafted-polymer particles may be the same as the gelatin starting material used for preparing the silver halide-gelatin particles or it may be a different gelatin, providing that the gelatin when attached to the silver halide grains has a different isoelectric pH than when grafted onto the polymer particles. This is due to the reaction of some of the amine groups in the gelatin molecule during the grafting reaction.

Figure 3:
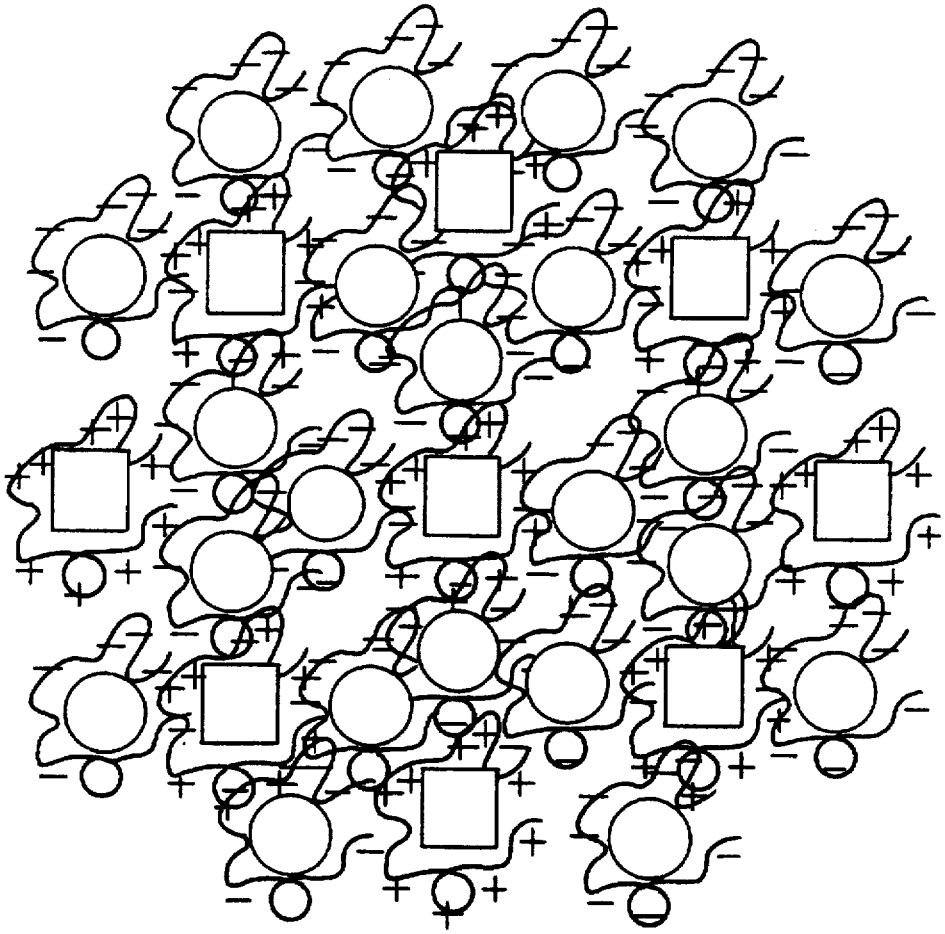
FIG. 3 illustrates a packet emulsion cluster formed by heteroflocculation.

In a preferred embodiment of this invention, phthalated gelatin-grafted-polymer particles are heteroflocculated with LPO gelatin pre-precipitated silver halide grains to form packet emulsion clusters. An initial stage of this heteroflocculation is shown in FIG. 2, in which a silver halide-gelatin particle, 10, and a gelatin-grafted-polymer particle 16 are joined together. The resulting composite cluster containing a number of each type of particle is shown in FIG. 3.

The phthalated gelatin-grafted-polymer-particles are heteroflocculated with the silver halide-gelatin particles by mixing the two types of particles in an aqueous medium and adjusting the pH of the medium by adding base or acid, as appropriate, to a pH value between the isoelectric pH values of the layers of gelatin surrounding the two different types of particles, that is between $P_1$ and $P_2$, and near the isoelectric pH of the isoing gelatin. Any base or acid can be used to adjust the pH. Preferred acids and bases include, for example, sulfuric acid, nitric acid, sodium hydroxide, etc. Usually the process of heterofloc formation is accompanied with vigorous agitation with a suitable device such as a tissue homogenizer to control the coagulation.

The process of physical heteroflocculation of the gelatin-grafted-polymer particles involves the dissimilarity of the net charge at a given pH between the gelatin bonded to the surface of the gelatin-grafted-polymer particles and the gelatin adsorbed on the surface of the silver halide particles, as depicted in FIG. 1*c*. If the pH of the medium is between $P_1$ and $P_2$, the charge on the outer gelatin layers of the two types of particles are opposite and the gelatin-grafted-polymer particles will be attached to the gelatin coated silver halide grains. This opposite charge interaction, combined with the coagulation caused by the isoing gelatin, forms the basis for the physical cluster formation (prior to chemical bonding) of the gelatin-grafted-polymer particles and the silver halide-gelatin particles.

The gelatin-grafted-polymer particles are preferably used in an amount sufficient to surround substantially the surface of the individual silver halide-gelatin particles.

The process described above results in composite particles in which are imbedded the gelatin pre-precipitated silver halide particles and the gelatin-grafted-polymer particles. The composite particle can be further chemically crosslinked for stability by using a gelatin cross linking agent. As there is little, if any, unbound gelatin in solution, the process will cause crosslinking of the gelatin surrounding the individual particles to form chemically bonded packet emulsion clusters. The cross linking agent used is preferably a gelatin hardener such as bisvinylsulfonylmethane ether, bisvinylsulfonylmethane, carbamoylonium compounds, dication ether compounds, carbodiimide compounds. Preferred cross linking agents are disclosed in above mentioned U.S. Pat. No. 5,026,632 to Bagchi et al. (RA-6).

In preferred embodiments of the invention phthalated gelatin-grafted-polymer particles are preferably loaded or imbibed with photographically useful compounds, such as couplers. The photographically useful compounds can also be incorporated in the core polymer of the phthalated gelatin-grafted-polymer particles, by the use of a polymeric photographically useful compound as the core polymeric particle.

The chemical compositions of the core polymer particles have been described extensively in U.S. Pat. No. 4,920,004 to Bagchi (RA-3); U.S. Pat. No. 4,885,219 to O'Conner et al.; U.S. Pat. No. 5,066,572 to Bagchi et al.; U.S. Pat. No. 5,055,379 to Bagchi et al. (RA-4); and U.S. Pat. No. 5,026,632 to Bagchi et al. (RA-6), which are incorporated herein by reference. The core polymer particle of the gelatin-grafted-polymer particles utilized in this invention can be loaded with one or a combination of the following types of photographic agents by the method described in U.S. Pat. No. 4,199,363 to Chen (RA-8) or that of U.S. Pat. No. 5,091,296 to Bagchi et al. (RA-9):

a. Filter Dyes, b. Development Inhibitor Release Couplers, c. Development Inhibitor Anchimeric Release Couplers, d. Dye-Forming Couplers, e. Nucleators, f. Development accelerators, g. Ultraviolet Radiation Absorbing Compounds, h. Sensitizing Dyes, i. Development Inhibitors, j. Antifoggants, k. Bleach Accelerators, etc.

The chemical compositions of the core polymeric photographic agent particles, useful for this invention, have been described extensively in related art U.S. Pat. No. 4,855,219 to Bagchi et al.; U.S. Pat. No. 5,066,572 to O'Conner et al.; U.S. Pat. No. 5,055,379 to Bagchi et al. (RA-4); U.S. Pat. No. 4,877,720 to Sato et al. (RA-13); U.S. Pat. No. 4,464,462 to Sujimoto et al. (RA-14); and U.S. Pat. No. 4,080,211 to Van Paesschen (RA-15), which are incorporated herein by reference. Typical polymeric core photographic agent particles suitable for this invention are as follows:

a. Polymeric Filter Dye Particles, b. Polymeric Development inhibitor Release Coupler Particles, c. Polymeric Development Inhibitor Anchimeric Release Coupler Particles, d. Polymeric Dye-Forming Coupler Particles, e. Polymeric Ultraviolet Radiation Absorbing Compound Particles, f. Polymeric Development Accelerator Particles, g. Polymeric Developer Particles, h. Polymeric Developer Bleachable Sensitizing Dye Particles, i. Polymeric Development inhibitors, j. Polymeric Antifoggants, k. Polymeric Bleach Accelerators, etc.

It is known that the incorporation of gelatin-grafted-soft polymer particles in photographic layers with silver halide emulsions can vastly improve the pressure sensitivity of photographic film products, without hindering developability of the photographic film, for example, see U.S. Pat. No. 4,855,219 to Bagchi et al.; U.S. Pat. No. 5,066,572 to O'Conner et al.; U.S. Pat. No. 5,055,379 to Bagchi et al. (RA-4); and U.S. Pat. No. 5,026,632 to Bagchi et al. (RA-6), the disclosures of which are incorporated herein by reference. As described in these patents, the polymer core of the gelatin-grafted-soft polymer particles is a polymer that is soft and deformable, preferably with a glass transition temperature of less than 25° C. and capable of being covalently bonded to gelatin, either directly or with the aid of a cross linking agent. Suitable materials are those polymer latex particles described in the above mentioned patents. A clustered packet silver halide emulsion containing gelatin grafted soft-polymer particles is believed to provide enhanced and improved pressure sensitivity of photographic elements, particularly those prepared from highly pressure sensitive thin tabular grain emulsions.

In other embodiments, this invention provides a mixed-packet color photographic coating as pictorially indicated in FIG. 4. In FIG. 4, support 20 has on a surface thereof a layer 21 comprising composite packet particles **22*a*, 22*b* and 22*c*, each comprising gelatin-grafted-polymer particles 16*a*, 16*b* and 16*c* which contain cyan-, magenta- and yellow-dye forming couplers, respectively, and silver halide-gelatin particles 10*a*, 10*b* and 10*c* which have been sensitized to red, green and blue light respectively. Thus the mixed packet photographic element is composed of red, blue, and green sensitized silver halide emulsions mixed in a single layer with the red emulsion associated with attached cyan dye-forming coupler, the green emulsion associated with magenta dye-forming coupler, and the blue emulsion associated with yellow dye-forming coupler. A dispersion of oxidized developer scavenger, 30**, may be interspersed among the packet emulsions to prevent color contamination between component particles. Since the surface area to protect from cross-talk in a mixed packet system is much larger than for a multilayer film, a macromolecular scavenger would be very useful. This is because such a polymeric scavenger will scavenge without penetrating into the packets, as it would if it were a low molecular weight soluble species.

The composite particles are separately prepared as discussed above for each color using (a) red sensitive silver halide grains having on the surface thereof adsorbed gelatin having an isoelectric pH of $P_{1a}$ and gelatin-grafted-polymer particles comprising a cyan dye forming coupler, in which particles the gelatin has an isoelectric pH of $P_{2a}$ which is different than $P_{1a}$; (b) green sensitive silver halide grains having on the surface thereof adsorbed gelatin having an isoelectric pH of $P_{1b}$ and gelatin-grafted-polymer particles comprising a magenta dye forming coupler in which particles the gelatin has an isoelectric pH of $P_{2b}$ which is different than $P_{1b}$; and blue sensitive silver halide grains having on the surface thereof adsorbed gelatin having an isoelectric pH of $P_{1c}$ and gelatin-grafted-polymer particles comprising a yellow dye forming coupler in which particles the gelatin has an isoelectric pH of $P_{2c}$ which is different than $P_{1c}$. Sensitizing dyes and couplers are well known in the art. Illustrations of sensitizing dyes and couplers that can be used are those disclosed in Research Disclosure 308119 (December 1989) Sections IV and VII respectively, the disclosures of which are incorporated herein by reference.

The silver halide packet emulsion prepared by the method of this invention, allows the proximity of gelatin-grafted-polymeric dye-forming coupler particles or gelatin-grafted-dye-forming coupler loaded polymer particles to the silver halide-gelatin particles. Therefore, the dye-forming coupler by the method of this invention is intimately associated with the silver halide particles. Preparation of red sensitized silver halide packet emulsions using gelatin-grafted-cyan coupler particles, green sensitized silver halide packet emulsions using gelatin-grafted-magenta coupler particles, and blue sensitized silver halide packet emulsions using gelatin-grafted-yellow coupler particles and coating them in a single layer as shown in FIG. 4 can provide a mixed-packet color photographic system.

These preformed silver halide-gelatin emulsion particles having gelatin-grafted-polymers adhered to them may be utilized in conventional photographic materials as well as in the mixed-packet photographic elements.

In other embodiments of the invention the silver halide grains may be sensitized to infrared or ultraviolet light.

The support can be any suitable support used with photographic elements. Typical supports include polymeric films, paper (including polymer-coated paper), glass and the like. Details regarding supports and other layers of the photographic elements of this invention are contained in Research Disclosure, December 1978, Item 17643, referred to above. The support can be coated with a magnetic recording layer as discussed in Research Disclosure 34390 of November 1992, the disclosure of which is incorporated herein by reference.

As described above this invention provides photographic agents such as filter dyes, development inhibitor release couplers, development inhibitor anchimeric release couplers, dye-forming couplers, nucleators, ultraviolet radiation absorbing materials, development accelerators, developers, sensitizing dyes, and various photographic agents close to the silver halide grain surface by incorporating or loading such agents into polymer particles then grafting gelatin to the particles and inducing heteroflocculation the resulting with silver halide-gelatin pre-precipitated particles. This results in the photographic agent being in close proximity with the silver halide grain surface.

In the event that the mixed packet color photographic systems of this invention is used in a thermal diffusion transfer mode (RA-33), the formed dye would have to be transferred to a receiving sheet. In this preferred embodiment the dye forming coupler particles will have to be modified such that the dye after development is free to diffuse to the receiving sheet. Such modifications are as follows:

1. The monomeric couplers in the latex particles of the packet emulsion are ballasted at the coupling off group.
2. The gelatin-grafted polymeric coupler particles of the packet emulsions are of such chemical structure that the dye-forming couplers are attached to the backbone of the polymer via the coupling off group (RA-35).

EXAMPLES

The following examples are intended to be illustrative and not exhaustive of the invention. Parts and percentages are by weight unless otherwise mentioned. Coating laydowns are given in "mg/ft$^2$." Multiplication of these numbers by 10.7 will convert them to "mg/m$^2$." In some cases the "mg/m$^2$" numbers are also included within parentheses "( )."

Example 1

Preparation of Poly(styrene-co-Butylocrylate-co-Methacrylac Acid) Latex of Weight Ratio (33/38/24):

This latex was prepared by standard emulsion polymerization procedure (RA-11) as follows. A 5-litre 3-neck round-bottom flask fitted with a condenser, an air stirrer and a supply for nitrogen under low blanketing pressure, was charged with 4 litre of nitrogen purged distilled water. The flask was placed in a constant temperature bath (CTB) at 60° C. After temperature equilibration, 0.4 g of sodium dodecyl sulfate surfactant was added to the reaction flask and a mixture of the following monomers:

| | |
|---|---|
| Styrene | 152 g |
| Butyl acrylate | 152 g |
| Methacrylic Acid | 96 g |
| Total | 400 g |

To the formed emulsion was added 2 g of $K_2S_2O_8$ and 1 g of $Na_2S_2O_5$. The polymerization reaction was carried out for 17 hours at 60° C. The latex had a solids content of 9.3%. The particle size of the latex was measured by photon correlation spectroscopy to be 95 nm. The calculated surface area of the latex was 63 m$^2$/g.

Example-2

Preparation Phthalated gelatinB-g-Latex of Example 1 (35% Phthalated Gelatin B)

Gelatin-grafted polymer particles used earlier (RA-3) were prepared with a large excess of gelatin than needed to saturate the surface of the particles. However, in order to use gelatin-grafted polymer particles to prepare heteroflocculated packet emulsion clusters, it is necessary to prepare gel-g-latex particles with no excess gelatin remaining in solution such that the excess gelatin does not have a chance to attach to the gelatin on the surface of the AgX grains, and that gel-g-latex particles are the only units that will attach to the surface of the gel coated AgX grains. Therefore, all gelatin-grafting procedures in this work were carried out with less gelatin than that necessary to completely cover the surface.

Gelatin adsorption has been extensively studied by Curme, et al. (RA-12) on Ag halide surfaces. As expected for ionizing polypeptides that contain —COOH and $NH_2$ groups, the adsorption excess is highly dependent on pH, and ionic strength. An estimate for use in synthetic work based upon this work (RA-12) is about 10 mg of gelatin adsorbed at saturation per square meter of surface.

The latex of Example 1 was grafted with the phthalated gelatin B described in Table 1. The phthalated gelatin covered 68% of the surface, in order to have no extra unattached gelatin in solution. The amounts of material used were as follows:

Latex of Example 1 at 9.3% solids=3720 g.

Therefore, dry polymer=3720×0.093=346 g.

The grafting agent I (as used in RA-3, RA-4 and RA-6) used was 0.2 mole per mole of surface methacrylic acid (assumed 5%), as before. In other words, weight of Compound I [carbamoyl sulfoethylpyridinium inner salt]used=(346×0.05×0.2×300)/86=12 g as 10% aqueous solution (the molecular weight) of methacrylic acid being 86 and that of Compound I being 300).

Dry phthalated gelatin B weight for 68% surface coverage was (346×63×0.68×0.01) =148 g. The gelatin was used at approximately 10% aqueous solution as before (RA-4 and RA-6).

The latex dispersion was taken in 3-neck round-bottom flask fitted with a condenser and heated to 60° C. in a constant temperature bath. The pH was adjusted to 8.0 using 20% NaOH solution. The 10% solution of Compound I was added to the latex and reaction continued at 60° C. for 15 minutes. The gelatin solution was heated to 60° C. and pH was adjusted to 8.0, and then added to the latex containing Compound I after 15 minutes of reaction. The grafting reaction was carried out for 15 minutes after the addition of the gelatin at 60° C. The prepared gel-g-latex was then dialyzed against distilled water continuously at 45° C. for 17 hours. The gel-g-latex was filtered through a fine nylon filter cloth. It had a final solids after dialysis of 5.9%. The phthalated gelatin B content of the dry gel-g-latex was then (148×100)/(148+346)=30%.

The most complete description of the preparation of gelatin grafted polymer particles is given in (RA-4 and RA-6). The chemistry of gelatin grafting to carboxylated latex is generally assumed to proceed according to the following pathway or ways.

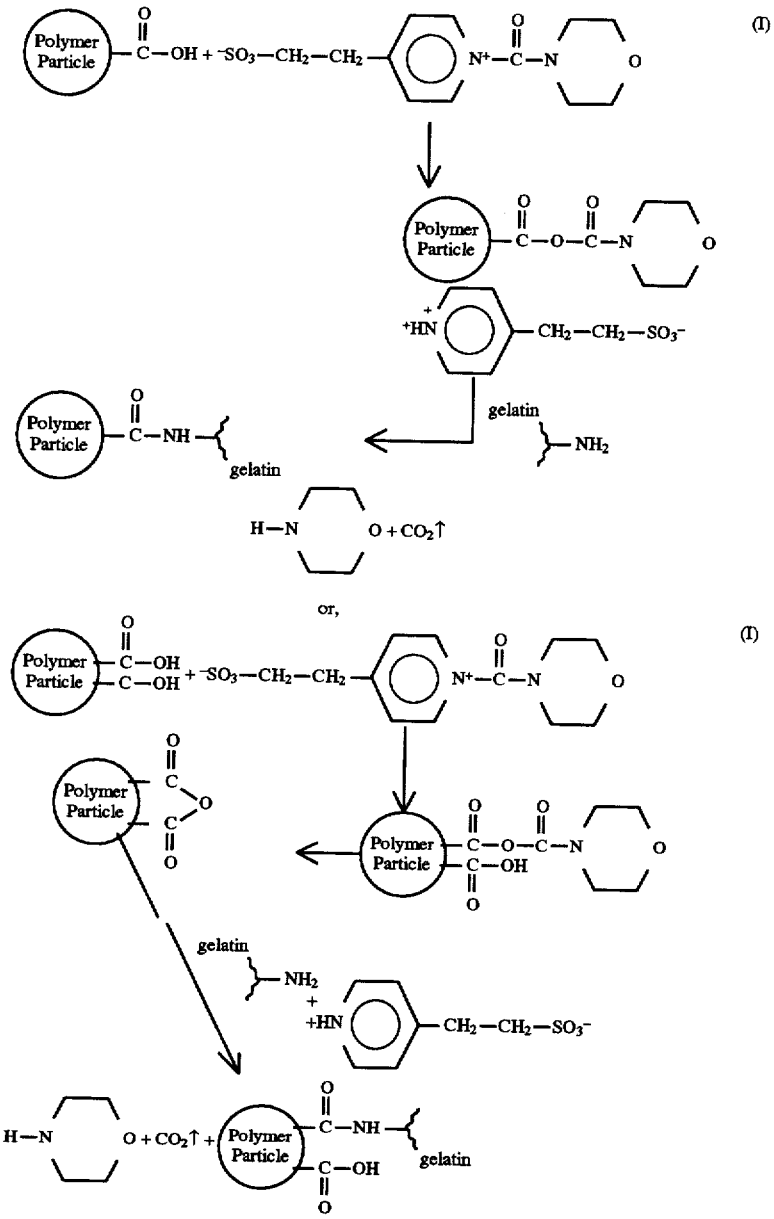

(I)

(I)

Example-3

Preparation of Cubic AgCl Emulsion in LPO Gelatin A

| | | |
|---|---|---|
| Make Kettle: | Rousselot LPO deionized gelatin | 200 g |
| | Nalco antifoam | 0.5 mL |
| | Deionized water | 3692 g |
| | Temperature | 55° C. |
| | Control set point | pAg = 7.20 |
| Silver Solution: | $AgNO_3$ | 4.5M |
| | $HgCl_2$ | 0.071 mg/Ag mole |
| | $HNO_3$ | 0.024M |
| Salt Solution: | NaCl | 4.5M |

Double-jet precipitation (RA-1) of the AgCl emulsion was carried out by adding the silver and the salt solutions to the kettle over a period of 39.9 minutes controlling the temperature and the pAg to the given set points. The initial Ag flow rate was 22 mL/minute ramped to 115 mL/minute. The emulsion was cooled to 43.3° C. and ultrafiltered to give a pAg of 6.51. 3.4 g of 4-chloro-3,5-xylenol. The final number average edge length of the cubic crystals was 337 nm as measured by electrolytic grain analysis (EGA) analysis.

Examples 4 and 5

Preparation of Tabular Grain AgBrI (3%I) Emulsions

Emulsions of Example 4 and Example 5 are the two tabular grain AgBrI (3%I) emulsions that were used to prepare heteroflocculated clustered emulsion packets. These two emulsions were prepared in an identical manner as described below:

| | | |
|---|---|---|
| Make Kettle: | Oxidized LPO Deionized Gelatin A | 10.5 g |
| | Nalco antifoam | 0.7 mL |
| | Deionized water | 3961 g |
| | pH adjusted to | 1.85 |
| | Initial temperature | 35° C. |
| | Growth temperature | 60° C. |
| | Initial set point | pAg = 9.63 |
| | Control set point | pAg = 8.94 |
| Silver Solution | $AgNO_3$ | 1.0M |
| Salt Solution | NaBr | 1.0M |
| Auxiliary Salt Solution (Tandem with Ag) | KI | 0.03M |

The preparation was a triple jet make with an auxiliary salt solution of KI, whose flow was maintained in tandem with the silver flow. The Ag and the salt solutions were added to the kettle at rates of 53 and 56 mL/minute, respectively, without controlling the pAg, in order to form nuclei under a twinning environment. Following nucleation for 30 seconds, the pumps were stopped and the temperature was ramped to 60° C. for 3 minutes and then 1 litre of a solution containing 133.4 of oxidized gelatin and 5.49 g of NaBr was dumped into the kettle. The pAg after the addition was 8.94. The pH was adjusted to 6.00 and then the $AgNO_3$ and the salt solutions were added to the kettle while controlling both the temperature and the pAg at the set points for a period of 63.5 minutes. The initial flow rate was 10 mL/minute, ramped to 117 mL/minute. The temperature was brought down to 40° C. after the make, and it was washed as described in Example 3 of reference (RA-29). The final gelatin concentration was made up to 40 g per mole of silver halide. 1.0 g of 4-chloro-3,5-xylenol was added as a preservative.

The equivalent circular diameters of these emulsion systems were determined by image analysis (Table II) and the average thickness values by measurement of coated reflection (Table II). These emulsions appear to be virtually similar to each other from the particle size characteristics shown in Table II.

TABLE II

Particle Size Characteristics of the Tabular Grain Emulsions of Examples 4 and 5

| Emulsion Example | Equivalent Circular Diameter (nm) | Average Thickness (nm) |
|---|---|---|
| 4 | 1200 | 45 |
| 5 | 1150 | 45 |

Figure 5:
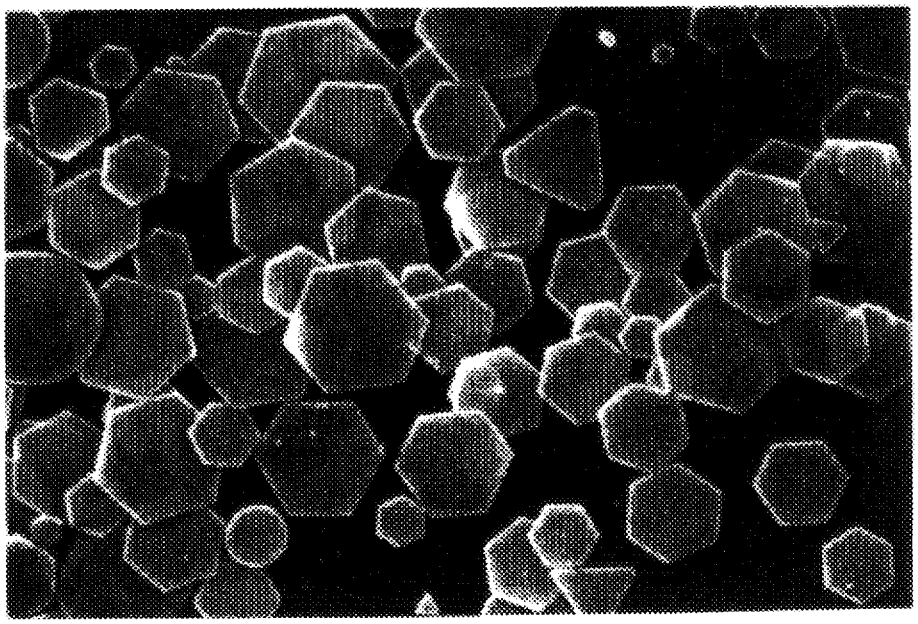
FIG. 5 illustrates scanning photomicrograph of tabular AgBI (3% I) emulsion of Example-4.

The electron photomicrographs of the emulsion of Example 4 is shown in FIG. 5.

Example 6

Preparation of Heteroflocculated Packet Emulsion Clusters Using Cubic AgCl Grains of Example-3 and Phthalated Gel-g-Latex of Example 2

Figure 6:
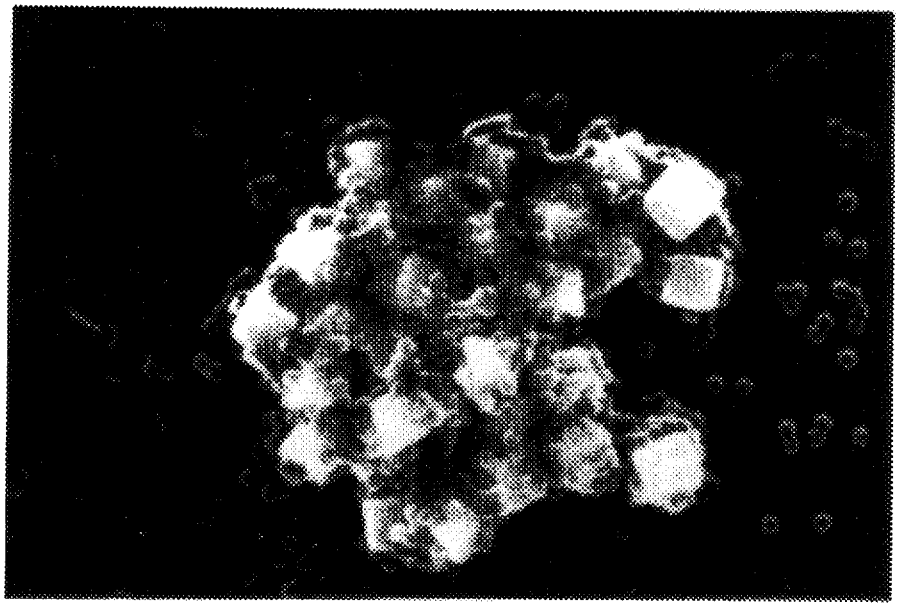
FIG. 6 illustrates representative scanning electron micrograph (SEM) of hardener stabilized heteroflocculated packet emulsion cluster of Example-6 prepared using the cubic AgCl emulsion of Example-3, precipitated in LPO gelatin A and phthalated gelatin-B-g-latex.

50 g (0.106 mole) of emulsion Example 3 was melted at 40° C. Then 0.152 mmoles of green sensitizing dye II was added and the temperature was increased to 60° C. in 12 minutes, held for 15 minutes, and then cooled to 40° C. 60 g of Gel-g-latex of Example 2 was added and the pH was adjusted to 3.80 with 4.0M $HNO_3$ with agitation to cause heteroflocculation. The flocculated clustered packets were allowed to settle. The supernatant was decanted and replaced with an equal amount of deionized water. The pH was adjusted back to 6.00 with a 2.5M NaOH solution. Next, the packet clusters were stabilized by adding the hardener bis(vinyl sulfonyl methane) (BVSM). It is to be noted that the emulsion of Example 3 was prepared with much reduced LPO gelatin A and the gel-g-latex was grafted to the extent of 75% surface coverage. Therefore, a condition was created to have very little or no free gel in solution in the heterocoagulated packet system. The hardening stabilization of the packets by the addition of a hardener will take place in the packets as there was no free gelatin left in the solution. This is similar to case hardening procedure described earlier (RA-6). The hardening was accomplished by adding 3.3 mL of 1.8% BVSM solution to this packet dispersion, dropwise under stirring. The stirred mixture was held at 40° C. for 6 hours. The sample was prepared for scanning electron microscopy (SEM) examination. A representative electron photomicrograph of the packet emulsion is shown in FIG. 6. It is seen that such a process of preparing packet emulsions can lead to larger ratios of gel-g-polymer particles to the emulsion crystals than just a monolayer coverage as described in (RA-30) and (RA-31) the picture of FIG. 6 shows what appeared to be an average sized packet (≈4μ in diameter). This example demonstrates packet formation using cubic emulsion grains.

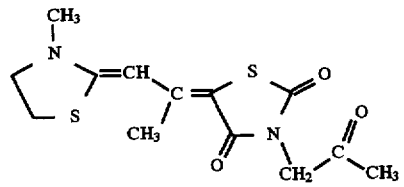

(II)

Example 7

Preparation of Heteroflocculated Emulsion Clusters Using Tabular Grain AgBrI (3%I) Emulsion of Example 4 and Phthalated Gelatin-g-latex of Example 1

Figure 7:
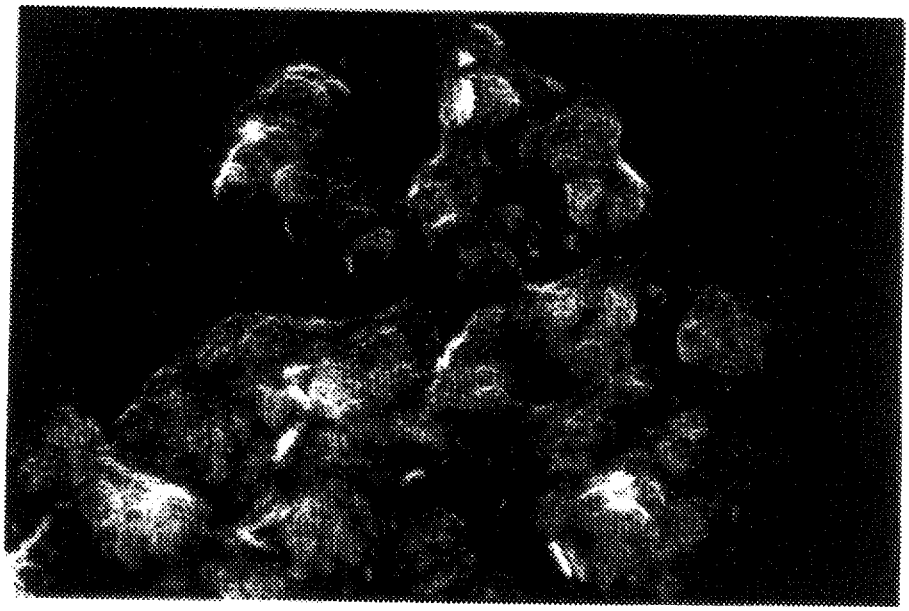
FIG. 7 illustrates representative scanning electron micrograph (SEM) of hardener stabilized heteroflocculated packet emulsion cluster of Example-7 prepared using the tabular AgBr I (3% I) emulsion of Example-4, precipitated in LPO gelatinA and phthalated gelatin-B-g-latex.

50 g (0.05 mole) of emulsion Example 4 was melted at 40° C. Then 0.152 mmoles of green sensitizing dye II was added and the temperature was increased to 60° C. in 12 minutes, held for 15 minutes and then cooled to 40° C. 60 g of gel-g-latex of Example 2 was added and the pH was adjusted down to 3.80 with 4.0N $HNO_3$ with stirring for cluster formation by heteroflocculation, as before. The clustered packets were then allowed to settle. The supernatant was decanted and replaced with an equal amount of deionized water. The pH was adjusted to 6.00 with 2.5N NaOH solution. For stabilization of the packets by mechanism similar to case hardening (RA-6), 3.3 mL of the gelatin hardener bis(vinyl sulfonyl methane) (BVSM) was added dropwise to the vigorously stirred mixture and held under stirring for 6 hours at 40° C. The sample was prepared for SEM examination as described earlier. A representative electron photomicrograph of the formed clustered packed emulsion is shown in FIG. 7. Such tabular emulsion grain clusters were somewhat larger than the packets prepared with the cubic AgCl emulsion grains of Example 6. The clusters appeared to be about 10 mm in diameter.

Examples 8 and 9

Preparation and Black and White Photographic Evaluation of a Hardened and an Unhardened Packet Emulsion Formed Using Cubic AgCl Emulsion of Example 3 and PA-7 Phthalated Gelatin-g-Latex of Example 2

The clustered packet emulsion prepared with the cubic AgCl emulsion of Example 3 were prepared with and without hardener for stabilization and the photographic property of the two packets were compared. The preparation of the packets and their evaluation is described in the following:

Packet Without Hardener Stabilization (Example 8)

Emulsion of Example 3 (0.1 mole) was melted at 40° C. The green sensitizing dye III was added at a level of 500 mg per mole of AgCl and heated to 60° C. Example 2 was added at 50 g per mole of AgCl and the pH was adjusted to 3.80 with 4.0N $HNO_3$ and with vigorous stirring. The packets formed were allowed to settle. The supernatant was decanted off and replaced with an equal volume of deionized (DI) water. The pH was adjusted back to 6.00 with a 2.5N NaOH solution, prior to coating.

Packet with Hardener Stabilization (Example 9)

This packet emulsion was prepared exactly the same way as the unhardened packet emulsion of Example 8, except after isolation of the packet 3.3 mL of 1.8% BVSM solution was added to the stirred packet emulsion for stabilization, dropwise at 40° C. for 2 hours, prior to coating.

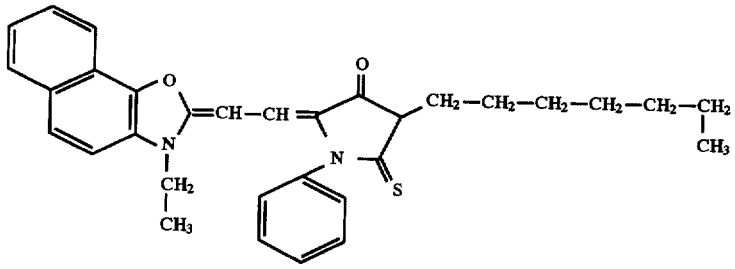

(III)

Photographic Evaluations

The above packet melts of Examples 8 and 9 were coated in a black and white format as follows:

| | |
|---|---|
| OVERCOAT | |
| Gelatin | 220 mg/sq ft (2,354 mg/m$^2$) |
| PACKET EMULSION LAYER: | |
| Total Silver Halide | 200 mg/sq ft (2,140 mg/m$^2$) |
| Total Gelatin | 220 mg/sq ft (2,354 mg/m$^2$) |
| SUB: | |
| Gelatin | 454 mg/sq ft (4,858 mg/m$^2$) |
| CELLULOSE TRIACETATE BASE | |
| REMJET: | |
| Carbon + Polymer | |

Each layer was coated with 0.051% by weight of the melt volume of the surfactant Triton® TX-200E and 0.025% by weight of the melt volume of the surfactant Olin 10G® as the spreading agents. The hardener used was BVSM at 1.55% of the total gel and was introduced in the overcoat layer. The coated strips were exposed in a Macbeth sensitometer with a light source whose color temperature was balanced at 2850° K. for 0.02 seconds through a neutral density step wedge. The exposed strips were processed using the $Cl^-$ modified elon ascorbic acid (RA-26) process at 68° F. The density of the strips at each step were measured for its visual density response and silver coverage by X-ray flourescence. The covering power relationship is the measured visual density divided by the mass of silver per unit area which produced that density.

The covering power of the Example 8 coating was 6.3 Dmax/mg Ag per ft2, while that of the Example 9 coating was 7.1 Dmax/mg Ag per ft2. It is seen that the two packet emulsions show just about the same covering power, irrespective of it being hardened or not. This indicates that the hardener stabilization of the packets do not affect the Ag imaging properties of such heteroflocculated packet emulsion systems.

Examples 10 and 11

Preparation of Cyan and Magenta Polymeric Coupler Latex

The polymeric coupler particles were prepared by semi-continuous emulsion polymerization techniques, as described in the following:

Magenta Polymeric Coupler (Example 10) Latex Particle (M). The composition of the polymer is given by structure IV.

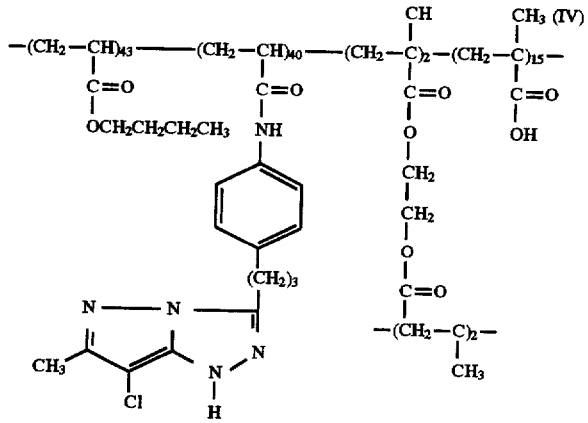

(IV)

Particle Diameter = 176nm
[Number indicates weight ratio]

The components for the magenta polymeric coupler system is shown in Table III. The polymerization reaction was carried out in a 12 L 3-neck flask fitted with an air driven stirrer, a condenser and a blanketing nitrogen inlet. The flask was immersed in a constant temperature bath, whose temperature was controlled using steam. The components A of Table III was added to the flask and the temperature of the bath was adjusted to 85° C. After temperature equilibration, the component of group B of Table III was added to the flask and stirred for 1 minute, then the components C of Table III was added to initiate polymerization. Polymerization was allowed to continue for 1 hour. The seed latex formed was used "in situ" for further growth using the more hydrophobic coupler monomer. To the seed polymer was then added further initiator of group D. The components of group E (monomers) and group F (initiator and surfactant) were then added simultaneously over a period of 8 hours. Most of the methanol was stripped off with an aspirator. The latex was filtered, dialyzed continuously against distilled water for at least three days and then concentrated by diafiltration. The final solids of the magenta polymeric coupler latex was 14.1%. The diameter of the latex as measured by PCS (photon correlation spectroscopy) was 176 nm.

TABLE III

Preparation of the Magenta Polymeric Coupler Latex Particles (M) of Example 10

| Group | Ingredient Name | Weight (g) |
|---|---|---|
| A | Water ($N_2$ purged) | 7200.0 |
| | Sodium dodecyl sulfate (SDS) | 22.5 |
| B | Butyl acrylate | 90.0 |
| C | $(NH_4)_2S_2O_8$ (APS) | 2.25 |
| D | APS | 4.5 |
| E | Magenta Coupler Monomer | 180.0 |
| | Butyl acrylate | 103.5 |
| | Methacrylic acid | 67.5 |
| | Ethylene dimethacrylate | 9.0 |
| | Dimethylformamide | 900.0 |
| | Methanol | 1125.0 |
| F | Water (N2 purged) | 900.0 |
| | SDS | 9.0 |
| | APS | 2.25 |

Magenta Coupler Monomer:

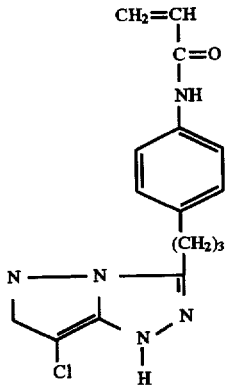

Cyan Polymeric Coupler (Example 11) Latex Particle (C). The composition of the polymer is given by structure V.

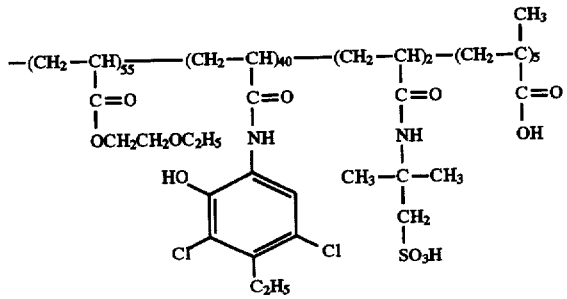

Particle Diameter = 81 nm

The cyan polymeric coupler particles were also prepared by a semicontinuous process as described below. The components for the preparation of the cyan polymeric coupler particles are shown in Table IV. The components of group A were charged into a similar 12L flask set in a bath at 85° C. The components were then added and stirred for 2 minutes to initiate polymerization. 240 mL of component C was then added and stirred for 2 minutes to initiate polymerization. 240 mL of component C was then added to the flask over a period of 1.5 hours. The rest of the components of C and D were pumped in simultaneously over a period of 16 hours. After the monomer feed was exhausted, the latex was allowed to stir for six or more hours at 85° C. The latex was then purified and isolated in much the same manner as described in the case of the magenta polymeric coupler system. The solids of this latex dispersion after diafiltration on concentration was 10.4% and the particle diameter of the latex was 81 nm as determined by PCS.

TABLE IV

Preparation of the Cyan Polymeric Coupler Latex Particles (C) of Example 11

| Group | Ingredient Name | Weight (g) |
|---|---|---|
| A | Water ($N_2$ purged) | 4500.0 |
| | Igepon T-77 | 30.0 |
| | Methanol | 600.0 |
| B | APS | 4.5 |
| | Water ($N_2$ purged) | 90.0 |
| C | Cyan Coupler Monomer | 180.0 |
| | Hydroxyethyl acrylate | 238.5 |
| | Methacrylic acid | 22.5 |
| | 2-Acrylamido-2-methyl propane sulfonic acid sodium salt | 9.0 |
| | Methanol | 1800.0 |
| D | Water (N2 purged) | 1800.0 |
| | Igepon T-77 | 12.0 |
| | APS | 4.5 |

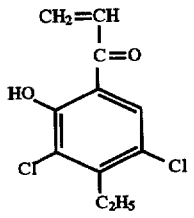

Cyan Coupler Monomer

Examples 12 and 13

Preparation of PA-7 Gel-g-Polymeric Couplers

Gelatin grafting reactions were carried out in the same manner as before and is indicated as follows:

Gel-g-Latex m [23% Phthalated Gelatin B](Example 12)

Gelatin-grafting reaction was carried out with amount of gelatin less than that needed to saturate the surface. 1773 g of the magenta polymer coupler latex M of example 10 at 14.1% solids was placed in a flask fitted with a condenser and a stirrer. The flask was placed in a constant temperature bath and heated to 60° C. with stirring and pH was adjusted to 8.0 using 20% NaOH solution. The weight of the polymer in the latex was 1773×0.14=248 g. The quantity of Compound I used was 0.2 moles per mole of surface methacrylic acid (assumed 5% of the total weight). Therefore, weight of Compound I is equal to (248×0.05×0.2×300)/86=8.6 g. The Compound I was dissolved in 86 g of water and added to the Magenta Latex M and allowed to react with stirring for 15 minutes at 60° C. 74.5 g of dry phthalated gelatin B was dissolved in 745 g of distilled water at 60° C. In this grafting reaction we have used 74.5/248=0.3 g of gelatin per g of latex. The latex diameter=0.3 g being 176 nm its surface area is 34 $m^2/g$. Therefore, the surface area covered by 0.3 g of gel for a saturation coverage of 0.01 $g/m^2$–0.3/0.01=$m^2/g$. Therefore, the extent of the surface coverage of the latex by gelatin is (30×100/34)=88%. The gel-g-latex sample was continuously dialyzed against distilled water at 45° C. for 17 hours. The gel-g-latex sample had a solids content of 11.3%. Determination of chlorine in a freeze-dried sample of the dialyzed gel-g-latex provided an equivalent weight of 1467, meaning that 1 mole of coupler monomer was present per 1467 g of the dry gel-g-latex. The % gelatin in the dry gel-g-latex was 74.5/(74.5+248)=23%. Gel-g-Latex C [33% Phthalated Gelatin B](Example 13)

The cyan gel-g-polymeric coupler was prepared much the same manner as above. The quantities of various materials used were as follows:

| | |
|---|---|
| Latex C at 10.4% solids | 2 kg at 60° C. and pH = 8.0 |
| Total solid polymer | 2000 × 0.104 = 208 g |
| Surface methacrylic acid | 208 × 0.05 = 10.4 g |
| Compound I | (10.4 × 0.2 × 300)/86 = 7.26 g in 10% aqueous solution |
| Phthalated gelatin B | 104 dissolved in 900 g of distilled water at 60° C. and pH 8.0 |
| Surface area of latex | 74 $m^2/g$ |
| Saturation gel weight | 74 × 0.01 × 208 = 154 |
| % surface covered | 74 × 100/154 = 48% |
| Solids of gel-g-latex C | after dialysis clean up 5.5% |
| Equivalent weight gel-g-latex C | from chlorine analysis 945 g |
| % gel in dry gel-g-latex C | 104/(104 + 208) = 33% |

The gel-g-latex samples were stored at 4° C. for further use.

Examples 14 and 15

Chemical and Spectral Sensitization of Tabular Grain AgBrI (3% I) Emulsion of Example 5.

Before preparation of the packet emulsions with using emulsion of Example 5 it was chemically and spectrally sensitized to red and green lights.

Red Sensitization (Example 14)

0.5 moles of emulsion of Example 5 was melted at 40° C. Sodium thiocyanate was added at a level of 112.5 mg per mole of silver halide and held for 5 minutes. Sodium thiosulfate was added at a level of 9 mg per mole of silver halide and held for 3 minutes. Potassium tetrachloroaurate was added at a level of 4.5 mg per mole of silver. The temperature was vamped from 40° C. to 65° C. in 15 minutes. The red sensitizing dye (VI) was added at a level of 1200 mg per mole of silver halide and held for 25 minutes. 1.75 g of tetraazaindene (TAI) per mole of silver halide was added and held for 5 minutes. The emulsion was chill set and held at 5° C. The emulsion was 1.034 kg per mole of silver.

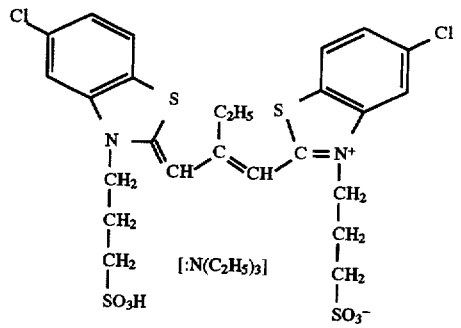

(VI)

Green Sensitization (Example 15)

0.5 moles of emulsion of Example 5 was melted at 40° C. Sodium thiocyanate was at a level of 112.5 mg per mole of silver and held for 5 minutes. Sodium thiosulfate was added at a level of 9 mg per mole of silver and held for 3 minutes. Potassium tetrachloroaurate was added at a level of 4.5 mg per mole of silver. The temperature was ramped from 40° C. to 65° C. in 15 minutes. The green sensitizing dye (VII) was added at a level of 1400 mg per mole of silver and held for 25 minutes. 1.75 g of TAI was added and held for 5 minutes. The emulsion was chill set and stored at 5° C. The packet emulsion was 0.957 kg per mole of silver.

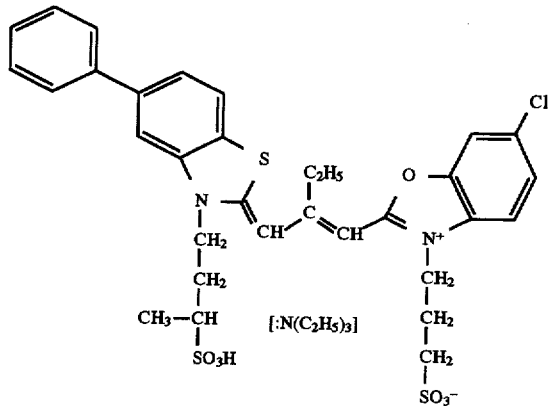

(VII)

Examples 16 and 17

Preparation of Packet Emulsions with Gel-g-Polymeric Coupler Latex Particles

Two sets of each red and green packet emulsions were prepared according to the following procedures:

Cyan Packet(PAK-C), (Example 16)

This was prepared with the red emulsion of Example 14 and phthalated gel-g-latex C 1. 70 g of its red sensitized emulsion of Example 14 and 550 g of gel-g-latex C of Example 13 were placed in a bar shaker in a CTB and melted at 40° C., with stirring. A second bar shaker was set up in the same manner.

2. The pH was adjusted to 3.80 with stirring to form the heteroflocculated packet clusters.

3. The packets were allowed to settle and the supernatant was decanted off and the content of the second bar shaker was placed into the first.

4. The weight of the bar shaker was adjusted back to 500 g by adding deionized water and then redispersed at 45° C. and mechanical stirring.

5. The pH was adjusted back to 5.40 and held with stirring for 30 minutes.

6. The packets were then filtered through a 47 micron mesh, chill set and refrigerated at 4° C.

Magenta Packet (PAK-M), Example 17

This was prepared with the green emulsion of Example 15 and phthalated gel-g-latex M of Example 12 in the following steps.

1. 75 g of the green sensitized emulsion of Example 15, 215 g of gel-g-latex M of Example 12 and 75 g of DI water were placed in two bar shakers in a CTB and melted at 40° C., with stirring. A second bar shaker was set up in the same manner.

Steps 2 through 6 were identical as in the case of the cyan packet.

Examples 18 and 19

Hardening of Packet Emulsions PAK-C (Example 16) and PAK M (Example 17)

In a bar shaker was placed 250 g of the packet emulsion and melted at 40° C. The packets were well dispersed with a medium sized tip of a tissue homogenizer (Cole Parmer) at the highest speed that generated little or no foam. 300 mL of a 10% solution of Compound I was prepared and slowly pumped into the stirred packet system at a rate of 10 mL per minute. The mixture was stirred for 1 hour at 40° C. It was deemed this was enough time for completion of hardening. The emulsion was iso-washed (RA-29) at pH of 3.80 to concentrate. The supernatant was decanted off and the weight was brought back up to 500 g by adding gelatin solution and water to achieve a final gelatin concentration of 2%. The melt was stirred at a higher homogenization speed to redisperse the packet for 30 minutes. The packets were then filtered at 45° C. through the 17 micron mesh. The melt was then chill set with stirring.

The hardened magenta packet was called HPAK-M (Example 18) and the hardened cyan packet was called HPAK-C (Example 19). The integrity of the hardened packet emulsions were determined by filtering a diluted dispersion through a 1.2 μm pore diameter. Gelman Acrodisc® filter and then by addition a drop of color developer for RA-4 process (RA-26) to about 5 cc of the filtrate, followed by the addition of a drop of 10% $K_2S_2O_8$ solution. In the case of the hardened packet emulsions no colored dye was formed whereas when the gel-g-latex dispersions were used as the control intense dye colors were formed. This clearly indicated that in the dispersed packet emulsion system, there was very little or no unclustered gel-g-polymeric coupler particles left in the continuous phase.

Examples 20 and 21

Photographic Evaluation of the Hardened Cyan (Example 19) and the Hardened Magenta (Example 18).

In order to determine the activities of the packet emulsion, the following types of coatings were prepared.

Magenta Packet Coating (Example 20)

The hardened magenta packet emulsion of Example 18 was coated in a monochrome format such that the sensitive layer contained 90 μ equivalent per square foot (963M equivalent per square meter) of the dye forming coupling group and 30 mg/ft$^2$ (321 mg/m$^2$) of the original AgBrI (3%I) emulsions. The coating format is as follows:

| | |
|---|---|
| OVERCOAT | |
| Gelatin | 300 mg/sq ft (3,210 mg/m$^2$) |
| BVSM | 1.55% of Total Gel |
| Triton TX-200E ® (Coating Aid) | 0.051% of Total Melt |
| Olin 10-G ® (Coating Aid) | 0.025% of Total Melt |
| EMULSION LAYER: | |
| Silver | 30 mg/sq ft (321 mg/m$^2$) |
| Gelatin | 300 mg/sq ft (3,210 mg/m$^2$) |
| Triton TX-200E ® (Coating Aid) | 0.051% of Total Melt |
| Olin 10-G ® (Coating Aid) | 0.25% of Total Melt |
| Coupling Moiety | 90 micro equiv/sq ft (963 micro equiv/m$^2$) |
| SUB: | |
| Gelatin | 454 mg/sq ft (4,858 mg/m$^2$) |
| CELLULOSE TRIACETATE BASE | |
| REMJET: | |
| Carbon + Polymer | |

Figure 8:
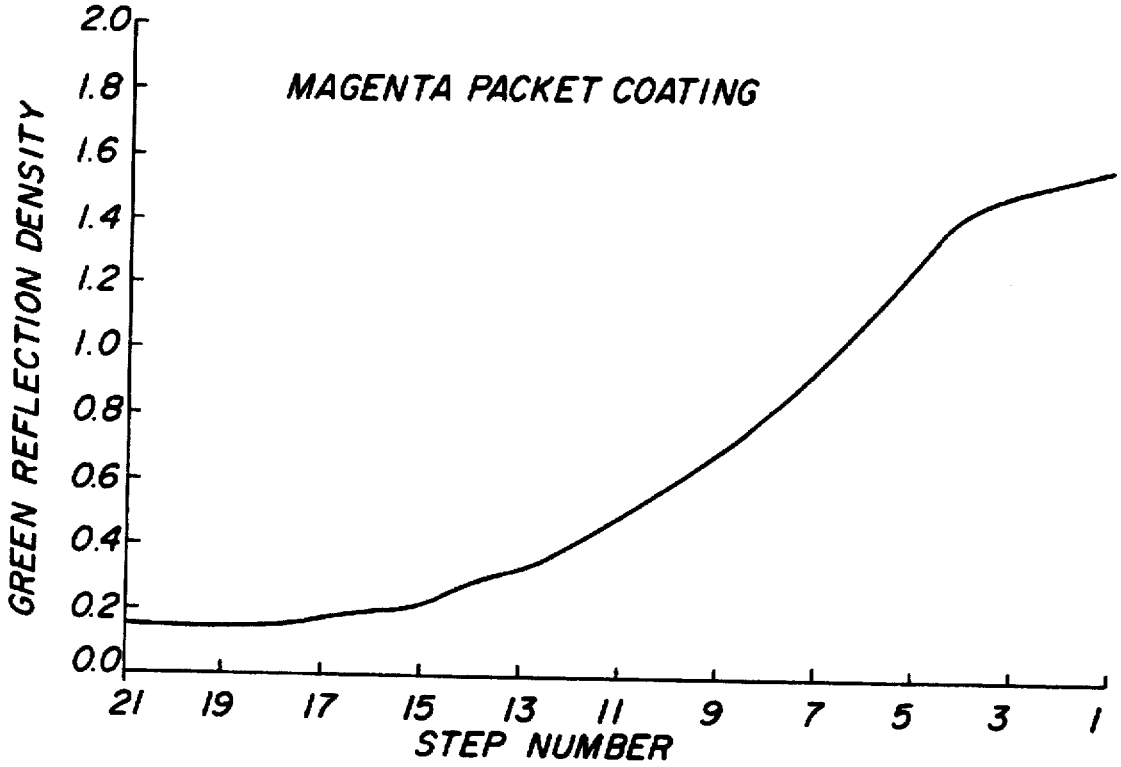
FIG. 8 illustrates the photographic sensitometric behavior of the hardened magenta packet coating of Example-20.

The coating was exposed for 1/50 of a second using a Macbeth exposing device with light source balanced at a color temperature of 5500° K. through a neutral step wedge and Wratten 99 (green) filter (RA-36). The coating was then processed by the well known RA-4 process (RA-25) with a 90 second development time. The processed strips were then laminated on a white reflecting resin coated paper base and the green reflection densities on each strip was read using a photographic densitometer. The resultant sensitometric curve is shown in FIG. 8. It is observed that a good magenta color scale as a function of exposure was obtained. This proves the utility and functional efficacy of a color packet emulsion system (in this case, magenta) prepared by the process and material of this invention.

Cyan Packet Coating (Example 21)

The hardened cyan packet emulsion of Example 19 was coated such that the sensitive layer contained 79μ equivalent per square feet (845 μ equivalent per square m) of the dye forming coupling group and 30 mg/ft$^2$ (321 mg/m$^2$) of the original AgBrI (3%I) emulsion. The coating formate is as follows:

| | |
|---|---|
| OVERCOAT | |
| Gelatin | 300 mg/sq ft (3,210 mg/m$^2$) |
| BVSM | 1.55% of Total Gel |
| Triton TX-200E ® (Coating Aid) | 0.051% of Total Melt |
| Olin 10-G ® (Coating Aid) | 0.025% of Total Melt |
| EMULSION LAYER: | |
| Silver | 30 mg/sq ft (321 mg/m$^2$) |
| Gelatin | 300 mg/sq ft (3,210 mg/m$^2$) |
| Triton TX-200E ® (Coating Aid) | 0.051% of Total Melt |
| Olin 10-G ® (Coating Aid) | 0.25% of Total Melt |
| Coupling Moiety | 79 micro equiv/sq ft (845 micro equiv/m$^2$) |
| SUB: | |
| Gelatin | 454 mg/sq ft (4,858 mg/m$^2$) |
| CELLULOSE TRIACETATE BASE | |
| REMJET: | |
| Carbon + Polymer | |

Figure 9:
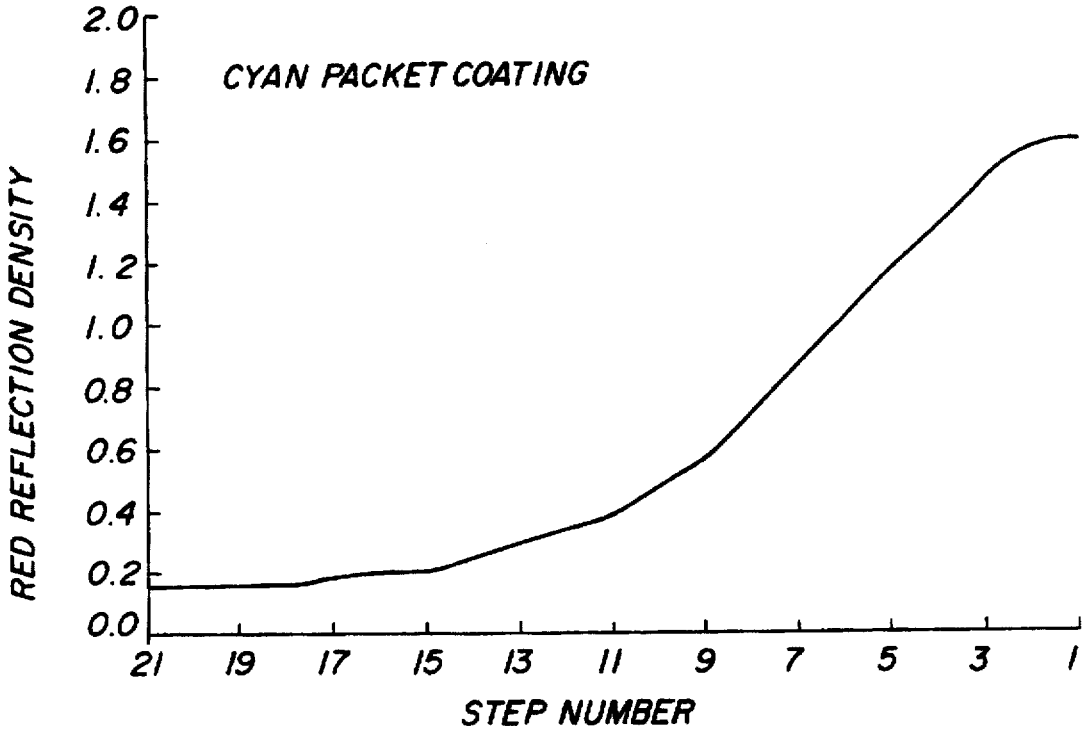
FIG. 9 illustrates photographic sensitometric behavior of the hardened cyan packet coating of Example-21.

They were exposed in much the same manner as in the case of the magenta packet except the color filter used was Wratten 29 (RA-36). The film strip was processed by RA-4 processing (RA-25) for 90 seconds development time. The processed strip was then laminated on a white reflecting resin coated paper base and the red reflection densities on each strip was read using a photographic densitometer. The resultant sensitometric curve is shown in FIG. 9. It is observed that a good cyan color scale as a function of exposure was obtained. This proves the utility and functional efficacy of a cyan color packet emulsion system was prepared by the process and material of this invention.

Examples 22, 23 and 24

Wandering of Oxidized Developer (Dox) Beyond Packet Boundary

In a mixed packet system one of the major concerns is the cross-talk between two color packets. To prevent such cross-talk we have proposed earlier the use of either a conventional dispersion of an oxidized developer scavenger or preferably a polymeric scavenger. In order to determine to what extent such Dox wandering takes place in a packet system, a set of three coatings were prepared according to the following format:

| | |
|---|---|
| OVERCOAT | |
| Gelatin | 200 mg/sq ft (2,140 mg/m$^2$) |
| BVSM | 1.55% of Total Gel |
| Triton TX-200E ® (Coating Aid) | 0.051% of Total Melt |
| Olin 10-G ® (Coating Aid) | 0.025% of Total Melt |
| EMULSION LAYER: | |
| Silver(In Magenta Packet) | 30 mg/sq ft (321 mg/m$^2$) |
| Gelatin | 300 mg/sq ft (3,210 mg/m$^2$) |
| Triton TX-200E ® (Coating Aid) | 0.051% of Total Melt |
| Olin 10-G ® (Coating Aid) | 0.025% of Total Melt |
| Cyan Coupling (VIII) | 90μ equiv/sq. ft.(963μ equiv/m$^2$) |
| Magenta Packet Coupler (IV) | 90μ equiv/sq. ft.(963μ equiv/m$^2$) |
| Dox Scavenger (IX) | 0, 30 and 90μ equiv/sq. ft. (0.321 and 963μ equiv/m$^2$) |
| SUB: | |
| Gelatin | 454 mg/sq ft (4,858 mg/m$^2$) |
| | CELLULOSE TRIACETATE BASE |
| REMJET: | |
| Carbon + Polymer | |

The magenta packet emulsion HPAK-C of Example 18 was coated along with a conventional dispersion of cyan coupler VIII (a 4-equivalent) coupler in the same layer at 90μ equivalent/sq. ft. (963 μ equivalent/m$^2$) of both the couplers in coupler VIII and the magenta polymeric coupler (IV) (A2-equivalent coupler moiety) along with a conventional dispersion of the Dox scavenger (IX) at levels of 0, 30 and 90μ equivalent/ft$^2$ (0, 321 and 963μ equivalent/m$^2$).

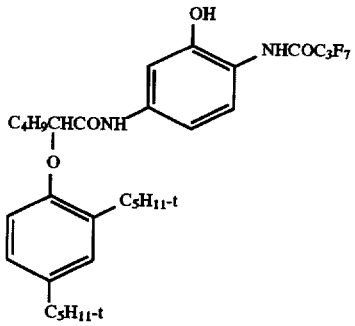

(VIII)

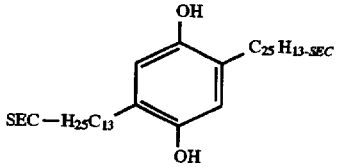

(IX)

The layer contained enough Ag+ in the packet emulsion to produce all the Dox necessary to produce dye with all the magenta coupler in the packet and the conventional cyan coupler dispersion. The scavenger (IX) was chosen for its high activity. The coatings were exposed identically as described in the case of the magenta packets as described earlier and processed for 90 sec in RA-4 developer as before (RA-26). Pictures of the images along with their microscopic top view and cross sections for the coatings with 0, 30 and 90 m equivalent to Dox scavenger (IX) (or 0, 21 and 62 mg per sq ft, respectively) per sq ft were evaluated. The laydowns in metric units are 0, 321 and 963 in equiv/m$^2$ or 0, 225 and 663 mg/m$^2$, respectively.

The image of of the coating containing no Dox scavenger was blue (cyan+magenta), while that of the coating with 30μ equivalent/ft$^2$ Dox scavenger was magenta with slight cyan contamination and that of the coating with 90μ equivalent/ft$^2$ Dox scavenger was completely magenta. The microscopic cross sections of the no Dox scavenger coating demonstrated that the magenta dye from the 3 packs appear as magenta clusters and the finely dispersed conventional cyan dye is interspersed between the packets. The general appearance of this image is blue. This is due to the wandering of the $D_{ox}$ out of the packets and formation of cyan dye inbetween the packets from the conventional dispersion. In the 30μ equivalent/ft$^2$ Dox scavenger coating it was seen that with very little cyan dye interspersed in the cross section, and the image was cyanish-magenta. At the highest level of the scavenger, it was seen that the image is completely magenta. Therefore, at this level all wandering of $D_{ox}$ out of the packet emulsion has been completely stopped. This demonstrates the efficacy of the use of such packet emulsions in the construction of a mixed packet color photographic system and reduction to practice of the concept of this invention.

Figure 10:
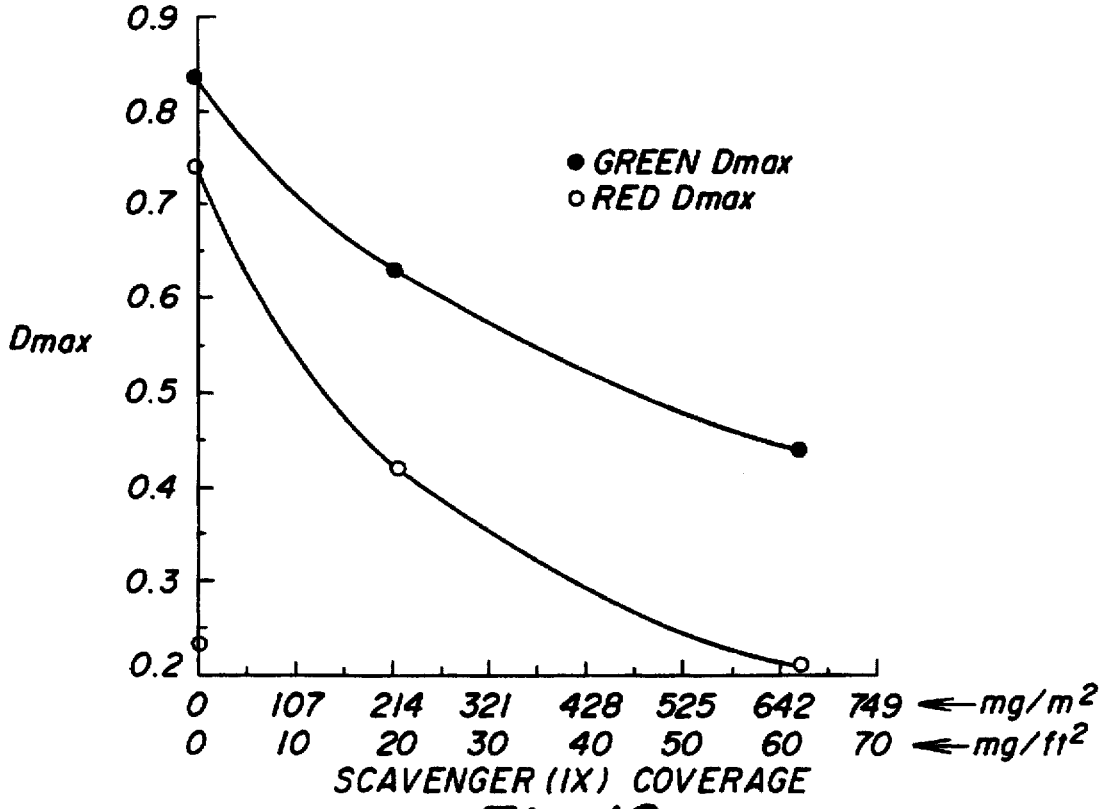
FIG. 10 illustrates plots of the transmission red and the green Dmax values of images of Examples 22–24 as a function of the level of scavenger-IX coverage in the coatings.

Both the red and the green D-max values of the images resulting from the three coatings are shown in FIG. 10, plotted as a function of the mg/ft$^2$ of scavenger in the coatings. It is seen that complete color purity is obtained at scavenger level equivalent to the molar equivalent level of the coupler. It is also seen that the increase of scavenger level in the coatings not only decreases the red density but also the green density. However, in FIG. 10 it is seen that the red D-max decays much faster than the green D-max as expected as the cyan coupler resides in the continuous phase of coating. Therefore, it is concluded that the scavenger (IX), which is not a polymeric scavenger, travels into the packets and diminishes the green packet dye formation. This is less desirable. Therefore, a polymeric scavenger that cannot penetrate into the packet is more preferred. This test is a very severe test for $D_{ox}$ wandering, as in reality of a mixed packet system, there will be no high covering power conventional dispersion but differently colored packets mixed together. Therefore, in the absence of scavenger, each packet will show full packet density but no high covering power nonpacket dye will be formed in the continuous phase, if stable packets are formed. This observation in general indicates that it is possible to create packets, in the absence of conventional dispersions, that may need only very little interparticle $D_{ox}$ scavengers. This will be especially true because the average distance between packet will be much larger than that between packet and conventional dispersion particles as coated in this experiment.

Examples 25 through 28

Cyan and Magenta Mixed Packet System Using Heteroflocculated Emulsion Packet Clusters In this section we shall describe the coating and photographic evaluation for color separation in a true mixed packet coating prepared from the hardened cyan packet HPAK-C (Example 19) and the hardened magenta packet HPAK-M (Example 18) as prepared earlier.

Mixed Packet Coating (Example 25)

The format for the cyan and magenta mixed packet coating is as follows:

| | |
|---|---|
| OVERCOAT | |
| Gelatin | 300 mg/sq ft (3,210 mg/m$^2$) |
| BVSM | 1.55% of Total Gel |
| Triton TX-200E ® (Coating Aid) | 0.051% of Total Melt |
| Olin 10-G ® (Coating Aid) | 0.025% of Total Melt |
| MIXED PACKET EMULSION LAYER: | |
| Triton TX-200E ® (Coating Aid) | 0.051% of Total Melt |
| Olin 10-G ® (Coating Aid) | 0.025% of Total Melt |
| Magenta Packet | |
| Silver | 40 mg/sq ft (428 mg/m$^2$) |
| Magenta Coupler (IV) | 133 mg/sq ft (1,423 mg/m$^2$) |
| Gelatin | 600 mg/sq ft (6,420 mg/m$^2$) |
| Cyan Packet | |
| Silver | 40 mg/sq ft (428 mg/m$^2$) |
| Cyan Coupler (V) | 180 mg/sq ft (1,926 mg/m$^2$) |
| ESTAR ® POLYESTER BASE | |

It is to be noted that the amount of gel in the mixed packet layer was further increased relative to the monochrome format in Examples 22–24, both to increase interpacket separation compared to the monochrome coatings, and to reduce the surface undulations formed in the coatings due to the packets. It is to be noted that no scavenger was coated in this mixed coating at all.

Mixed Packet Exposure Conditions (Example 26)

The mixed packet coating was exposed using the same exposure device as indicated earlier. For red exposure Wratten 29 (RA-36) and for green exposure Wratten 99 (RA-36) were used. For a red+green exposure, the strips were exposed once with Wratten 99 and once with Wratten 29. When the mixed packet strip is exposed to red light (Wratten 29) only the cyan packets will be exposed. However, due to substantial absorption of the cyan packet emulsion in the green, exposure of the packet coating to green light (Wratten 99) will not only expose the magenta packet but the cyan packet as well. This is bacause of the sensitivities of the sensitizing dye pair. Red sensitization can be moved to longer wavelengths to minimize the overlap of the red and green sensitivities for cleaner exposure if desired.

Based upon the sensitization characteristics, it is expected that best color separation should be observed only in the red exposed strips. The green exposed strips should show some color contamination in the mixed packet coatings. Therefore, conclusions regarding mixed packet color separation for the above described mixed packet coatings should be made from only the red exposed strips.

Evaluation of the Mixed Packet Coating With RA4 Development (Example 27)

First the mixed packet coating was exposed with red+green lights and processed by RA4 development (RA-26) process. Pictures of the processed strip along with photomicrographic cross sections of typical fields at both high and low density steps were obtained. As expected, the cross sections of the processed coating showed both developed cyan and magenta packets, and the image looked blue (cyan+magenta). In the high density areas the packet development was fuller and the packets appeared as larger dye spots than in the low density areas. It was apparent from the cross sections that the packet size distribution was broad and there appeared to be a few packets as large as 10 μm in diameter. It was also seen that these large packets, still with higher gel laydowns, cause surface undulations. A microscopic view from the surface of the coatings at high and low exposure areas showed that in the high density areas the overlapping exposed packets appear blue, and the individual color packets can hardly be discerned. However, the view of the low density area, as expected, clearly showed a mixture of both developed cyan and magenta packets with high dye density.

Examination of pictures of the processed (90 RA4) mixed packet coatings with red and green color separation exposures and photomicrographic cross sections of the coatings at high and low density steps indicated that the green exposure yields a magenta iamge and the red exposure results in a cyan image. This indicated a reasonable degree of color separation was achieved, even without any interparticle $D_{ox}$ scavenger in the coating.

The test of color separation is really pertinent to the red exposed film because of the overlapping spectral sensitizations discovered earlier. Cross section of the red exposed image, in both high exposure and the low exposure areas, revealed predominantly the cyan packets and minute amounts of magenta. This observation clearly demonstrated that color separation can indeed be achieved in a mixed packet layer of this invention, even with no incorporated $D_{ox}$ scavenger. Surface micrographs of the high and low exposure areas of the red separation exposures of Example 27 showed only developed cyan packets, consistent with the conclusion reached above.

At low exposures, the green separation exposure of the mixed packet coating did yield a magenta image, despite the green-light sensitivity of the cyan packet. The cross sections of the RA4 processed green separation exposure showed both developed cyan and magenta packets as expected, although the density, if not actual numbers of the developed cyan packets, appeared less than for a red exposure. On the other hand, there were a considerable number of developed magenta packets, and at low exposures, significantly more of these than the cyan. Thus, the film appeared magenta. Microscopic top views of the green-only exposed image beared out the same conclusions.

Therefore, it is concluded from the observations above that it is indeed feasible to obtain color separation in a mixed packet coating of this invention, by formulation of the packets in the described manner and by choosing the proper sensitizing dye set.

Evaluation of the Mixed Packet Coating With E6 Development (Example 28)

The mixed packet coating described above was also developed in E6 process (RA-26) for 4 minutes. Pictures of the processed coatings with red and green color separation exposures along with photomicrographic cross sections of the coatings at high and low density steps were obtained, as were surface micrographs of the coatings in the high and low density areas. It is to be noted that in reversal E6 processing the remaining silver is developed, which will produce magenta dye for red exposure and cyan dye for green exposure. According to previous discussion on the green sensitivity of the red emulsion, best color separation should be observed in the red exposed strips.

The red and green color separation exposures were given in the same was as indicated earlier. The cross sections in the D-max area, where both cyan and magenta dyes should be formed (reversal), revealed, as expected, both developed cyan and magenta packets. The low density areas of the red exposed strip showed magenta packets only. This again is a clear proof of obtaining good color separation in the mixed packet coating of this invention. Because of the green sensitivity of the cyan packet emulsion we did not expect to see good color separation in the green exposed strip. Nonetheless, the cross section of the low density areas of the green exposed strip revealed primarily cyan packets. The observation of such excellent color separation in the green exposed film was unexpected. The micrographic top views were consistent with the conclusions made above.

This invention has been described in detail with particular reference to preferred embodiments thereof, but it will be understood that variations and modifications can be effected within the spirit and scope of the invention.

What is claimed is:

1. A photosensitive silver halide emulsion composition comprising in an aqueous medium:

(a) silver halide-gelatin particles comprising silver halide grains, each surrounded by a layer of adsorbed peptizing gelatin wherein the peptizing gelatin has an isoelectric pH of $P_1$; and (b) gelatin-grafted-polymer particles wherein the grafted gelatin has an isoelectric pH of $P_2$ which is different than $P_1$;

wherein at least one of the peptizing and grafted gelatins is an isoing gelatin, and the gelatin-grafted-polymer particles and the silver halide gelatin-particles form a heteroflocculated cluster, packet emulsion composition.

2. The composition of claim 1 wherein the gelatin of the gelatin-grafted-polymer particles and the silver halide gelatin-particles in the packet cluster are chemically bonded to each other by interparticle crosslinks via their gelatin shells.

3. The composition of claim 1 wherein the gelatin-grafted polymer particles comprise a polymer having a glass transition temperature of less than 25° C.

4. The composition of claim 1 wherein said gelatin-grafted polymer particles comprise a photographic agent selected from at least one member of the group consisting of:

filter dyes, development inhibitor release couplers, development inhibitor anchimeric release couplers, dye-forming couplers, nucleators, accelerators for photographic development, ultraviolet radiation absorbing compounds, sensitizing dyes, development inhibitors, antifoggants, and bleach accelerators.

5. The composition of claim 1 wherein said gelatin-grafted polymer particles comprise grafted gelatin and a polymer selected from at least one member of the group consisting of:

polymeric filter dye, polymeric development inhibitor release coupler, polymeric development inhibitor anchimeric release coupler, polymeric dye-forming coupler, polymeric ultraviolet radiation absorbing compound, polymeric development accelerator, polymeric developer, polymeric sensitizing dye, polymeric development inhibitors, polymeric antifoggants, and polymeric bleach accelerators.

6. The composition of claim 1 wherein the peptizing gelatin of the silver halide-gelatin particles and the grafted gelatin of the gelatin-grafted-polymer particles are different and are each selected from the group consisting of:

acid processed ossein gelatin, lime processed ossein gelatin, phthalated gelatin, acetylated gelatin, and succinated gelatin.

7. The composition of claim 1 wherein the peptizing gelatin surrounding the silver halide grains is a lime processed ossein gelatin and the grafted gelatin bonded to the polymer particles is selected from the group consisting of:

phthalated gelatin, acetylated gelatin, and succinated gelatin.

8. The composition of claim 1 wherein the average diameter of the heteroflocculated packet emulsion clusters is between 1 μm to 100 μm.

9. The composition of claim 1 wherein the average diameter of the hetero flocculated packet clusters is between 1 μm and 5 μm.

10. The composition of claim 4 wherein the photographic agent comprises a dye-forming coupler which is ballasted at the coupling-off group.

11. The composition of claim 4 wherein the photograph agent is a sensitizing dye which is developer bleachable.

12. The composition of claim 5 wherein the polymer comprises a polymeric dye-forming coupler which has pendant dye-forming coupler moieties that are attached to the polymer backbone via a coupling-off group.

13. The composition of claim 5 wherein the polymer comprises a polymeric sensitizing dye which is developer bleachable.

14. The composition of claim 5 wherein the polymer comprises a polymeric dye forming coupler such that the formed image dye is imagewise thermally transferable to a receiver sheet.

15. A method of preparing a photographic silver halide emulsion composition comprising:

(i) mixing in an aqueous medium (a) silver halide-gelatin particles comprising silver halide grains, each surrounded by a layer of adsorbed peptizing gelatin wherein the peptizing gelatin has an isoelectric pH of $P_1$; and (b) gelatin-grafted-polymer particles wherein the grafted gelatin has an isoelectric pH of $P_2$ which is different than $P_1$;

wherein at least one of the peptizing and grafted gelatins is an isoing gelatin, and (ii) adjusting the pH of the aqueous medium to a value that is between $P_1$ and $P_2$, and within 0.5 pH units of the isoelectric pH of an isoing gelatin, under agitation whereby gelatin-grafted-polymer particles and silver halide gelatin particles heteroflocculate to form a clustered heteroflocculated packet emulsion composition.

16. The method of claim 15 wherein said gelatin-grafted-polymer particles comprise at least one photographic agent selected from at least one member of the group consisting of:

filter dyes, development inhibitor release couplers, development inhibitor anchimeric release couplers, dye-forming couplers, nucleators, accelerators for photographic development, ultraviolet radiation absorbing compounds, sensitizing dyes, development inhibitors, antifoggants, and bleach accelerators.

17. The method of claim 15 wherein said gelatin-grafted polymer particles comprise grafted gelatin and a polymer selected from at least one member of the group consisting of:

polymeric filter dye, polymeric development inhibitor release coupler, polymeric development inhibitor anchimeric release coupler, polymeric dye-forming coupler, polymeric ultraviolet radiation absorbing compound, polymeric development accelerator, polymeric developer, polymeric sensitizing dye, polymeric development inhibitors, polymeric antifoggants, and polymeric bleach accelerators.

18. The method of claim 15 wherein the peptizing gelatin of the silver halide-gelatin particles and the grafted gelatin of the gelatin-grafted-polymer particles are different and are each selected from the group consisting of:

acid processed ossein gelatin, lime processed ossein gelatin, phthalated gelatin, acetylated gelatin, and succinated gelatin.

19. The method of claim 15 wherein the gelatin-grafted-polymer particles are chemically bonded to the silver halide-gelatin particles using a gelatin hardener selected from any of the following or a mixture thereof:

bisvinylsulfonylmethane ether, bisvinylsulfonylmethane, carbamoylonium compounds, dication ether compounds, carbodiimide compounds.

20. The method of claim 15 wherein the peptizing gelatin surrounding the silver halide grains is a lime processed ossein gelatin and the grafted gelatin bonded to the polymer particles is selected from the group consisting of:

phthalated gelatin, acetylated gelatin, and succinated gelatin.

21. The method of claim 16 wherein the photographic agent comprises a dye-forming coupler which is ballasted at a coupling-off group.

22. A mixed-packet photosensitive photographic element comprising a support bearing a layer containing at least two of the following packet emulsion clusters:

(a) silver halide particles sensitive to red light and comprising silver halide grains each surrounded with a layer of peptizing gelatin wherein the peptizing gelatin has an isoelectric pH of $P_{1a}$ and hetero-flocculated with gelatin-grafted-polymer particles comprising a cyan dye-forming coupler wherein the grafted gelatin has an isoelectric pH of $P_{2a}$ which is different than $P_{1a}$, to form a red packet cluster, (b) silver halide particles sensitive to green light and comprising silver halide grains each surrounded with a layer of peptizing gelatin wherein the peptizing gelatin has an isoelectric pH of $P_{1b}$ and hetero-flocculated with gelatin-grafted-polymer particles comprising a magenta dye-forming coupler wherein the grafted gelatin has an isoelectric pH of $P_{2b}$ which is different than $P_{1b}$, to form a green packet cluster, or (c) silver halide particles sensitive to blue light and comprising silver halide grains each surrounded with a layer of peptizing gelatin wherein the peptizing gelatin has an isoelectric pH of $P_{1c}$ and hetero-flocculated with gelatin-grafted-polymer particles comprising a yellow dye-forming coupler wherein the grafted gelatin has an isoelectric pH of $P_{2c}$ which is different than $P_{1c}$, to form a blue packet cluster, wherein in each packet emulsion cluster (a), (b) and (c) at least one of the peptizing or grafted gelatins is isoable.

23. The element of claim 22 wherein the gelatin-grafted-polymer particles of at least one emulsion cluster comprise polymer particles loaded with a dye-forming coupler.

24. The element of claim 22 wherein the gelatin-grafted-polymer particles of at least one emulsion cluster comprise grafted gelatin and a polymeric dye forming coupler.

25. The element of claim 22 wherein the peptizing gelatin of the silver halide-gelatin particles and the grafted gelatin of the gelatin-grafted-polymer particles of at least one emulsion cluster are different and are each selected from the group consisting of:

acid processed ossein gelatin, lime processed ossein gelatin, phthalated gelatin, acetylated gelatin, and succinated gelatin.

26. The element of claim 22 further comprising a dispersion of oxidized developer scavenger to prevent color contamination.

27. The element of claim 22 comprising packet cluster emulsions with average diameter less than 5 μm.

* * * * *